US008077130B2

(12) United States Patent
Pai et al.

(10) Patent No.: US 8,077,130 B2
(45) Date of Patent: Dec. 13, 2011

(54) METHOD FOR DRIVING AN LCD DEVICE

(75) Inventors: Cheng-Chiu Pai, Hsin-Chu (TW); Tsang-Hong Wang, Hsin-Chu (TW); Chung-Chun Chen, Hsin-Chu (TW); Kung-Yi Chan, Hsin-Chu (TW); Huan-Hsin Li, Hsin-Chu (TW); Chung-Lung Li, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 752 days.

(21) Appl. No.: 12/183,076

(22) Filed: Jul. 31, 2008

(65) Prior Publication Data

US 2009/0278776 A1 Nov. 12, 2009

(30) Foreign Application Priority Data

May 8, 2008 (TW) ..... 97116988 A

(51) Int. Cl.
*G09G 3/36* (2006.01)

(52) U.S. Cl. ..... 345/96

(58) Field of Classification Search ..... 345/87–102
See application file for complete search history.

(56) References Cited

U.S. PATENT DOCUMENTS

| | | | | |
|---|---|---|---|---|
| 6,429,842 | B1 | 8/2002 | Shin | |
| 7,084,849 | B2 | 8/2006 | Noguchi | |
| 7,215,309 | B2 * | 5/2007 | Yamato et al. | 345/87 |
| 7,623,107 | B2 * | 11/2009 | Deane | 345/96 |
| 7,928,948 | B2 * | 4/2011 | Hagino et al. | 345/96 |
| 2003/0107544 | A1 * | 6/2003 | Edwards | 345/96 |
| 2005/0162363 | A1 | 7/2005 | Kim | |
| 2006/0007094 | A1 | 1/2006 | Kang | |
| 2007/0063952 | A1 | 3/2007 | Oku et al. | |

FOREIGN PATENT DOCUMENTS

| | | | |
|---|---|---|---|
| CN | 1937026 | A | 3/2007 |
| CN | 101131808 | A | 2/2008 |

* cited by examiner

*Primary Examiner* — Bipin Shalwala
*Assistant Examiner* — Steven Holton
(74) *Attorney, Agent, or Firm* — Winston Hsu; Scott Margo

(57) ABSTRACT

A method for driving an LCD device having a plurality of sets of gate lines is disclosed. The method includes sequentially enabling odd gate lines of a first set of gate lines in ascending order for writing first-polarity data into corresponding pixels based on a first common voltage during a first interval, sequentially enabling even gate lines of the first set of gate lines in ascending order for writing second-polarity data into corresponding pixels based on a second common voltage during a second interval, sequentially enabling even gate lines of a second set of gate lines in descending order for writing second-polarity data into corresponding pixels based on the second common voltage during a third interval, and sequentially enabling odd gate lines of the second set of gate lines in descending order for writing first-polarity data into corresponding pixels based on the first common voltage during a fourth interval.

9 Claims, 22 Drawing Sheets

200

| | | | | | | |
|---|---|---|---|---|---|---|
| First row | + | + | + | + | + | + |
| Second row | – | – | – | – | – | – |
| Third row | + | + | + | + | + | + |
| Fourth row | – | – | – | – | – | – |
| Fifth row | + | + | + | + | + | + |
| Sixth row | – | – | – | – | – | – |

FIG. 2 RELATED ART

500

| | | | | | | |
|---|---|---|---|---|---|---|
| First row | + | + | + | + | + | + |
| Second row | – | – | – | – | – | – |
| Third row | + | + | + | + | + | + |
| Fourth row | – | – | – | – | – | – |
| Fifth row | + | + | + | + | + | + |
| Sixth row | – | – | – | – | – | – |
| Seventh row | + | + | + | + | + | + |
| Eighth row | – | – | – | – | – | – |
| Ninth row | + | + | + | + | + | + |
| Tenth row | – | – | – | – | – | – |
| Eleventh row | + | + | + | + | + | + |
| Twelfth row | – | – | – | – | – | – |
| Thirteenth row | + | + | + | + | + | + |
| Fourteenth row | – | – | – | – | – | – |
| Fifteenth row | + | + | + | + | + | + |
| Sixteenth row | – | – | – | – | – | – |
| Seventeenth row | + | + | + | + | + | + |
| Eighteenth row | – | – | – | – | – | – |

FIG. 5

800

| | | | | | | |
|---|---|---|---|---|---|---|
| First row | + | + | + | − | − | − |
| Second row | − | − | − | + | + | + |
| Third row | + | + | + | − | − | − |
| Fourth row | − | − | − | + | + | + |
| Fifth row | + | + | + | − | − | − |
| Sixth row | − | − | − | + | + | + |
| Seventh row | + | + | + | − | − | − |
| Eighth row | − | − | − | + | + | + |
| Ninth row | + | + | + | − | − | − |
| Tenth row | − | − | − | + | + | + |
| Eleventh row | + | + | + | − | − | − |
| Twelfth row | − | − | − | + | + | + |
| Thirteenth row | + | + | + | − | − | − |
| Fourteenth row | − | − | − | + | + | + |
| Fifteenth row | + | + | + | − | − | − |
| Sixteenth row | − | − | − | + | + | + |
| Seventeenth row | + | + | + | − | − | − |
| Eighteenth row | − | − | − | + | + | + |

FIG. 9

| | | | | |
|---|---|---|---|---|
| First set of intervals | First interval | Td1 | Writing the data signals with positive polarity into the pixel units of the odd pixels in the first row | Vcom= First voltage |
| | | Td2 | Writing the data signals with positive polarity into the pixel units of the odd pixels in the third row and the even pixels in the second row | Vcom= First voltage |
| | | Td3 | Writing the data signals with positive polarity into the pixel units of the odd pixels in the fifth row and the even pixels in the fourth row | Vcom= First voltage |
| | Second interval | Td4 | Writing the data signals with negative polarity into the pixel units of the odd pixels in the second row and the even pixels in the first row | Vcom= Second voltage |
| | | Td5 | Writing the data signals with negative polarity into the pixel units of the odd pixels in the fourth row and the even pixels in the third row | Vcom= Second voltage |
| | | Td6 | Writing the data signals with negative polarity into the pixel units of the odd pixels in the sixth row and the even pixels in the fifth row | Vcom= Second voltage |
| Second set of intervals | First interval | Td1 | Writing the data signals with negative polarity into the pixel units of the odd pixels in the twelfth row and the even pixels in the eleventh row | Vcom= Second voltage |
| | | Td2 | Writing the data signals with negative polarity into the pixel units of the odd pixels in the tenth row and the even pixels in the ninth row | Vcom= Second voltage |
| | | Td3 | Writing the data signals with negative polarity into the pixel units of the odd pixels in the eighth row and the even pixels in the seventh row | Vcom= Second voltage |
| | Second interval | Td4 | Writing the data signals with positive polarity into the pixel units of the odd pixels in the eleventh row and the even pixels in the tenth row | Vcom= First voltage |
| | | Td5 | Writing the data signals with positive polarity into the pixel units of the odd pixels in the ninth row and the even pixels in the eighth row | Vcom= First voltage |
| | | Td6 | Writing the data signals with positive polarity into the pixel units of the odd pixels in the seventh row and the even pixels in the sixth row | Vcom= First voltage |
| Third set of intervals | First interval | Td1 | Writing the data signals with positive polarity into the pixel units of the odd pixels in the thirteenth row and the even pixels in the twelfth row | Vcom= First voltage |
| | | Td2 | Writing the data signals with positive polarity into the pixel units of the odd pixels in the fifteenth row and the even pixels in the fourteenth row | Vcom= First voltage |
| | | Td3 | Writing the data signals with positive polarity into the pixel units of the odd pixels in the seventeenth row and the even pixels in the sixteenth row | Vcom= First voltage |
| | Second interval | Td4 | Writing the data signals with negative polarity into the pixel units of the odd pixels in the fourteenth row and the even pixels in the thirteenth row | Vcom= Second voltage |
| | | Td5 | Writing the data signals with negative polarity into the pixel units of the odd pixels in the sixteenth row and the even pixels in the fifteenth row | Vcom= Second voltage |
| | | Td6 | Writing the data signals with negative polarity into the pixel units of the odd pixels in the eighteenth row and the even pixels in the seventeenth row | Vcom= Second voltage |

FIG. 10

| | | | | |
|---|---|---|---|---|
| First set of intervals | First interval | Td1 | Writing the data signals with positive polarity into the pixel units of the odd pixels in the first row | Vcom= First voltage |
| | | Td2 | Writing the data signals with positive polarity into the pixel units of the odd pixels in the third row and the even pixels in the second row | Vcom= First voltage |
| | | Td3 | Writing the data signals with positive polarity into the pixel units of the odd pixels in the fifth row and the even pixels in the fourth row | Vcom= First voltage |
| | Second interval | Td4 | Writing the data signals with negative polarity into the pixel units of the odd pixels in the second row and the even pixels in the first row | Vcom= Second voltage |
| | | Td5 | Writing the data signals with negative polarity into the pixel units of the odd pixels in the fourth row and the even pixels in the third row | Vcom= Second voltage |
| | | Td6 | Writing the data signals with negative polarity into the pixel units of the odd pixels in the sixth row and the even pixels in the fifth row | Vcom= Second voltage |
| Second set of intervals | First interval | Td1 | Writing the data signals with positive polarity into the pixel units of the odd pixels in the eleventh row and the even pixels in the tenth row | Vcom= First voltage |
| | | Td2 | Writing the data signals with positive polarity into the pixel units of the odd pixels in the ninth row and the even pixels in the eighth row | Vcom= First voltage |
| | | Td3 | Writing the data signals with positive polarity into the pixel units of the odd pixels in the seventh row and the even pixels in the sixth row | Vcom= First voltage |
| | Second interval | Td4 | Writing the data signals with negative polarity into the pixel units of the odd pixels in the twelfth row and the even pixels in the eleventh row | Vcom= Second voltage |
| | | Td5 | Writing the data signals with negative polarity into the pixel units of the odd pixels in the tenth row and the even pixels in the ninth row | Vcom= Second voltage |
| | | Td6 | Writing the data signals with negative polarity into the pixel units of the odd pixels in the eighth row and the even pixels in the seventh row | Vcom= Second voltage |
| Third set of intervals | First interval | Td1 | Writing the data signals with positive polarity into the pixel units of the odd pixels in the thirteenth row and the even pixels in the twelfth row | Vcom= First voltage |
| | | Td2 | Writing the data signals with positive polarity into the pixel units of the odd pixels in the fifteenth row and the even pixels in the fourteenth row | Vcom= First voltage |
| | | Td3 | Writing the data signals with positive polarity into the pixel units of the odd pixels in the seventeenth row and the even pixels in the sixteenth row | Vcom= First voltage |
| | Second interval | Td4 | Writing the data signals with negative polarity into the pixel units of the odd pixels in the fourteenth row and the even pixels in the thirteenth row | Vcom= Second voltage |
| | | Td5 | Writing the data signals with negative polarity into the pixel units of the odd pixels in the sixteenth row and the even pixels in the fifteenth row | Vcom= Second voltage |
| | | Td6 | Writing the data signals with negative polarity into the pixel units of the odd pixels in the eighteenth row and the even pixels in the seventeenth row | Vcom= Second voltage |

FIG. 11

990

| | First cloumn | Second cloumn | Third cloumn | Fourth cloumn | Fifth cloumn | Sixth cloumn |
|---|---|---|---|---|---|---|
| First row | + | − | + | − | + | − |
| Second row | − | + | − | + | − | + |
| Third row | + | − | + | − | + | − |
| Fourth row | − | + | − | + | − | + |
| Fifth row | + | − | + | − | + | − |
| Sixth row | − | + | − | + | − | + |
| Seventh row | + | − | + | − | + | − |
| Eighth row | − | + | − | + | − | + |
| Ninth row | + | − | + | − | + | − |
| Tenth row | − | + | − | + | − | + |
| Eleventh row | + | − | + | − | + | − |
| Twelfth row | − | + | − | + | − | + |
| Thirteenth row | + | − | + | − | + | − |
| Fourteenth row | − | + | − | + | − | + |
| Fifteenth row | + | − | + | − | + | − |
| Sixteenth row | − | + | − | + | − | + |
| Seventeenth row | + | − | + | − | + | − |
| Eighteenth row | − | + | − | + | − | + |

FIG. 13

| | | | | |
|---|---|---|---|---|
| First set of intervals | First interval | Td1 | Writing the data signals with positive polarity into the odd pixel units in the first row | Vcom= First voltage |
| | | Td2 | Writing the data signals with positive polarity into the odd units in the third row and the even pixel units pixel in the second row | Vcom= First voltage |
| | | Td3 | Writing the data signals with positive polarity into the odd pixel units in the fifth row and the even pixel units in the fourth row | Vcom= First voltage |
| | Second interval | Td4 | Writing the data signals with negative polarity into the odd pixel units in the second row and the even pixel units in the first row | Vcom= Second voltage |
| | | Td5 | Writing the data signals with negative polarity into the odd pixel units in the fourth row and the even pixel units in the third row | Vcom= Second voltage |
| | | Td6 | Writing the data signals with negative polarity into the odd pixel units in the sixth row and the even pixel units in the fifth row | Vcom= Second voltage |
| Second set of intervals | First interval | Td1 | Writing the data signals with positive polarity into the pixel pixel units in the twelfth row and the even pixel units in the eleventh row | Vcom= Second voltage |
| | | Td2 | Writing the data signals with negative polarity into the odd pixel units in the tenth row and the even pixel units in the ninth row | Vcom= Second voltage |
| | | Td3 | Writing the data signals with negative polarity into the odd pixel units in the eighth row and the even pixel units in the seventh row | Vcom= Second voltage |
| | Second interval | Td4 | Writing the data signals with positive polarity into the odd pixel units in the eleventh row and the even pixel units in the tenth row | Vcom= First voltage |
| | | Td5 | Writing the data signals with positive polarity into the odd pixel units in the ninth row and the even pixel units in the eighth row | Vcom= First voltage |
| | | Td6 | Writing the data signals with positive polarity into the odd pixel units in the seventh row and the even pixel units in the sixth row | Vcom= First voltage |
| Third set of intervals | First interval | Td1 | Writing the data signals with positive polarity into the odd pixel units in the thirteenth row and the even pixel units in the twelfth row | Vcom= First voltage |
| | | Td2 | Writing the data signals with positive polarity into the odd pixel units in the fifteenth row and the even pixel units in the fourteenth row | Vcom= First voltage |
| | | Td3 | Writing the data signals with positive polarity into the odd pixel units in the seventeenth row and the even pixel units in the sixteenth row | Vcom= First voltage |
| | Second interval | Td4 | Writing the data signals with negative polarity into the odd pixel units in the fourteenth row and the even pixel units in the thirteenth row | Vcom= Second voltage |
| | | Td5 | Writing the data signals with negative polarity into the odd pixel units in the sixteenth row and the even pixel units in the fifteenth row | Vcom= Second voltage |
| | | Td6 | Writing the data signals with negative polarity into the odd pixel units in the eighteenth row and the even pixel units in the seventeenth row | Vcom= Second voltage |

FIG. 14

| | | | | |
|---|---|---|---|---|
| First set of intervals | First interval | Td1 | Writing the data signals with positive polarity into the odd pixel units in the first row | Vcom= First voltage |
| | | Td2 | Writing the data signals with positive polarity into the odd pixel units in the third row and the even pixel units in the second row | Vcom= First voltage |
| | | Td3 | Writing the data signals with positive polarity into the odd pixel units in the fifth row and the even pixel units in the fourth row | Vcom= First voltage |
| | Second interval | Td4 | Writing the data signals with negative polarity into the odd pixel units in the second row and the even pixel units in the first row | Vcom= Second voltage |
| | | Td5 | Writing the data signals with negative polarity into the odd pixel units in the fourth row and the even pixel units in the third row | Vcom= Second voltage |
| | | Td6 | Writing the data signals with negative polarity into the odd pixel units in the sixth row and the even pixel units in the fifth row | Vcom= Second voltage |
| Second set of intervals | First interval | Td1 | Writing the data signals with positive polarity into the odd pixel units in the eleventh row and the even pixel units in the tenth row | Vcom= First voltage |
| | | Td2 | Writing the data signals with positive polarity into the odd pixel units in the ninth row and the even pixel units in the eighth row | Vcom= First voltage |
| | | Td3 | Writing the data signals with positive polarity into the odd pixel units in the seventh row and the even pixel units in the sixth row | Vcom= First voltage |
| | Second interval | Td4 | Writing the data signals with negative polarity into the odd pixel units in the twelfth row and the even pixel units in the eleventh row | Vcom= Second voltage |
| | | Td5 | Writing the data signals with negative polarity into the odd pixel units in the tenth row and the even pixel units in the ninth row | Vcom= Second voltage |
| | | Td6 | Writing the data signals with negative polarity into the odd pixel units in the eighth row and the even pixel units in the seventh row | Vcom= Second voltage |
| Third set of intervals | First interval | Td1 | Writing the data signals with positive polarity into the odd pixel units in the thirteenth row and the even pixel units in the twelfth row | Vcom= First voltage |
| | | Td2 | Writing the data signals with positive polarity into the odd pixel units in the fifteenth row and the even pixel units in the fourteenth row | Vcom= First voltage |
| | | Td3 | Writing the data signals with positive polarity into the odd pixel units in the seventeenth row and the even pixel units in the sixteenth row | Vcom= First voltage |
| | Second interval | Td4 | Writing the data signals with negative polarity into the odd pixel units in the fourteenth row and the even pixel units in the thirteenth row | Vcom= Second voltage |
| | | Td5 | Writing the data signals with negative polarity into the odd pixel units in the sixteenth row and the even pixel units in the fifteenth row | Vcom= Second voltage |
| | | Td6 | Writing the data signals with negative polarity into the odd pixel units in the eighteenth row and the even pixel units in the seventeenth row | Vcom= Second voltage |

FIG. 15

METHOD FOR DRIVING AN LCD DEVICE

BACKGROUND OF THE INVENTION

1. Field of the Invention

The present invention relates to a method for driving an LCD device, and more particularly, to a method for driving an LCD device with high display quality by suppressing the mura effect based on an interlace-commutate scanning process for sequentially enabling a plurality of sets of gate lines.

2. Description of the Prior Art

Because liquid crystal display (LCD) devices are characterized by thin appearance, low power consumption, and low radiation, LCD devices have been widely applied in various electronic products for panel displaying. In general, an LCD device comprises liquid crystal cells encapsulated between two substrates and a backlight module for providing lighting source. The operation of an LCD apparatus is featured by varying voltage drops between opposite sides of the liquid crystal cells for twisting the angles of the liquid crystal molecules of the liquid crystal cells so that the transparency of the liquid crystal cells can be controlled for illustrating images with the aid of the backlight module.

It is well known that the polarity of voltage drop across opposite sides of the liquid crystal cells should be inverted periodically for protecting the liquid crystal cells from causing permanent deterioration due to polarization, and also for reducing image sticking effect on the LCD device. In general, the LCD panel driving operations can be categorized into the frame-inversion driving operation, the line-inversion driving operation, the pixel-inversion driving operation, and the dot-inversion driving operation.

While driving an LCD device based on the frame-inversion driving operation, the polarities of data signals applied to each liquid crystal cell are inverted with respect to alternating display frames. The line-inversion driving operation comprises the column-inversion driving operation and the row-inversion driving operation. While driving an LCD device based on the column-inversion driving operation, the polarities of data signals applied to each liquid crystal cell are inverted with respect to alternating data lines. While driving an LCD device based on the row-inversion driving operation, the polarities of data signals applied to each liquid crystal cell are inverted with respect to alternating gate lines. While driving an LCD device based on the pixel-inversion driving operation, the data signals having opposite polarities are applied to adjacent pixels, and the data signals of the red, green, and blue pixel units in the same pixel have the same polarity. While driving an LCD device based on the dot-inversion driving operation, the data signals having opposite polarities are applied to adjacent pixel units. Among the aforementioned LCD panel driving operations, the pixel-inversion driving operation and the dot-inversion driving operation are well known to provide better display quality. In view of that, recently LCD panels have mainly used the pixel-inversion driving operation or the dot-inversion driving operation for displaying images.

FIG. 1 is a schematic diagram showing a prior-art LCD device based on the row-inversion driving operation. As shown in FIG. 1, the LCD device 100 comprises a plurality of data lines 160, a plurality of gate lines 150, a plurality of common lines 180, and a plurality of pixel units 170. For ease of explanation, the LCD device 100 in FIG. 1 illustrates six data lines 160, six common lines 180, and six gate lines 150 (GL1-GL6). All the common lines 180 are furnished with a common voltage Vcom. Each data line 160 is utilized for receiving one corresponding data signal. Each gate line 150 is utilized for receiving one corresponding gate signal. For instance, the first gate line GL1 is utilized for receiving the first gate signal SGL1, the sixth gate line GL6 is utilized for receiving the sixth gate signal SGL6, and the rest can be inferred by analogy. Each pixel unit 170 is a red pixel unit, a green pixel unit, or a blue pixel unit. Each pixel unit 170 comprises a data switch 171 and a storage unit 173. Each data switch 171 is turned on/off in response to one corresponding gate signal furnished by one corresponding gate line 150. Each data signal is written into one corresponding storage unit 173 via one corresponding data line 160 under the control of one corresponding data switch 171.

FIG. 2 is a schematic diagram showing pixel polarities in the Nth frame illustrated by the LCD device shown in FIG. 1. The positive polarity, represented by sign "+" in FIG. 2, means that the voltage of the corresponding data signal is positive with respect to the common voltage Vcom. The negative polarity, represented by sign "−" in FIG. 2, means that the voltage of the corresponding data signal is negative with respect to the common voltage Vcom. In the Nth frame 200 shown in FIG. 2, the data signals with positive polarity are written into the pixel units disposed in odd rows, and the data signals with negative polarity are written into the pixel units disposed in even rows. FIG. 3 shows the related signal waveforms regarding the operation of the LCD device in FIG. 1 for generating the Nth frame in FIG. 2 based on a prior-art LCD driving method, having time along the abscissa. The sign "+" in parentheses means that the polarity of the corresponding written data signal is positive, and the sign "−" in parentheses means that the polarity of the corresponding written data signal is negative. As shown in FIG. 3, the prior-art LCD driving method divides the frame time for generating the Nth frame 200 into a first interval and a second interval. During the first interval, the common voltage Vcom is set to be a low voltage, and the gate signals of odd gate lines are sequentially enabled for writing the data signals with positive polarity into odd rows of pixel units. During the second interval, the common voltage Vcom is set to be a high voltage, and the gate signals of even gate lines are sequentially enabled for writing the data signals with negative polarity into even rows of pixel units.

For instance, during the consecutive sub-intervals Td1, Td2 and Td3 within the first interval, the gate signals SGL1, SGL3 and SGL5 are sequentially enabled for writing the data signals with positive polarity sequentially into the pixel units 170 of the first, third and fifth rows via the plurality of data lines 160. During the consecutive sub-intervals Td1, Td2 and Td3 within the second interval, the gate signals SGL2, SGL4 and SGL6 are sequentially enabled for writing the data signals with negative polarity sequentially into the pixel units 170 of the second, fourth and sixth rows via the plurality of data lines 160.

However, in the aforementioned prior-art LCD driving method, each frame time is only divided into two intervals for writing the data signals with different polarities into the pixel units of the odd and even rows respectively, which results in higher deviations of data signals between adjacent rows of pixel units due to current leakages of data switches. Accordingly, the display quality of the prior-art LCD device is degraded due to the mura effect caused by the higher deviations of data signals between adjacent rows of pixel units. Furthermore, the voltage level of common voltage switches only once within each frame time, and therefore the brightness offset of pixel units becomes more serious following the drift of the common voltage. Moreover, both the enabling sequences of gate signals during the first and second intervals are incremental or decremental, which is likely to degrade display quality by causing unwanted frame brightness gradient.

SUMMARY OF THE INVENTION

In accordance with an embodiment of the present invention, a method for driving an LCD device with high display quality by suppressing the mura effect is released. The LCD device comprises a plurality of rows of pixels, a plurality of sets of gate lines, and a plurality of data lines.

The method comprises sequentially enabling a plurality of gate signals corresponding to a plurality of odd gate lines in a first set of gate lines based on a first sequential order during a first interval of a first set of intervals, sequentially enabling a plurality of gate signals corresponding to a plurality of even gate lines in the first set of gate lines based on a second sequential order during a second interval of the first set of intervals, sequentially enabling a plurality of gate signals corresponding to a plurality of even gate lines in a second set of gate lines based on a third sequential order during a first interval of a second set of intervals following the first set of intervals, and sequentially enabling a plurality of gate signals corresponding to a plurality of odd gate lines in the second set of gate lines based on a fourth sequential order during a second interval of the second set of intervals. The first and second intervals of the first set of intervals are not overlapped. Also, the first and second intervals of the second set of intervals are not overlapped.

These and other objectives of the present invention will no doubt become apparent to those of ordinary skill in the art after reading the following detailed description of the preferred embodiment that is illustrated in the various figures and drawings.

BRIEF DESCRIPTION OF THE DRAWINGS

FIG. 2 is a schematic diagram showing pixel polarities in the Nth frame illustrated by the LCD device shown in FIG. 1.

FIG. 5 is a schematic diagram showing pixel polarities in the Mth frame illustrated by the LCD device shown in FIG. 4.

FIG. 9 is a schematic diagram showing pixel polarities in the Ith frame illustrated by the LCD device shown in FIG. 8.

FIG. 10 presents a process list depicting the related writing operations for generating the Ith frame in FIG. 9 based on the related signal waveforms in FIG. 6.

FIG. 11 presents a process list depicting the related writing operations for generating the Ith frame in FIG. 9 based on the related signal waveforms in FIG. 7.

FIG. 13 is a schematic diagram showing pixel polarities in the Lth frame illustrated by the LCD device shown in FIG. 12.

FIG. 14 presents a process list depicting the related writing operations for generating the Lth frame in FIG. 13 based on the related signal waveforms in FIG. 6.

FIG. 15 presents a process list depicting the related writing operations for generating the Lth frame in FIG. 13 based on the related signal waveforms in FIG. 7.

DETAILED DESCRIPTION

Hereinafter, preferred embodiments of the present invention will be described in detail with reference to the accompanying drawings. Here, it is to be noted that the present invention is not limited thereto.

Figure 1:
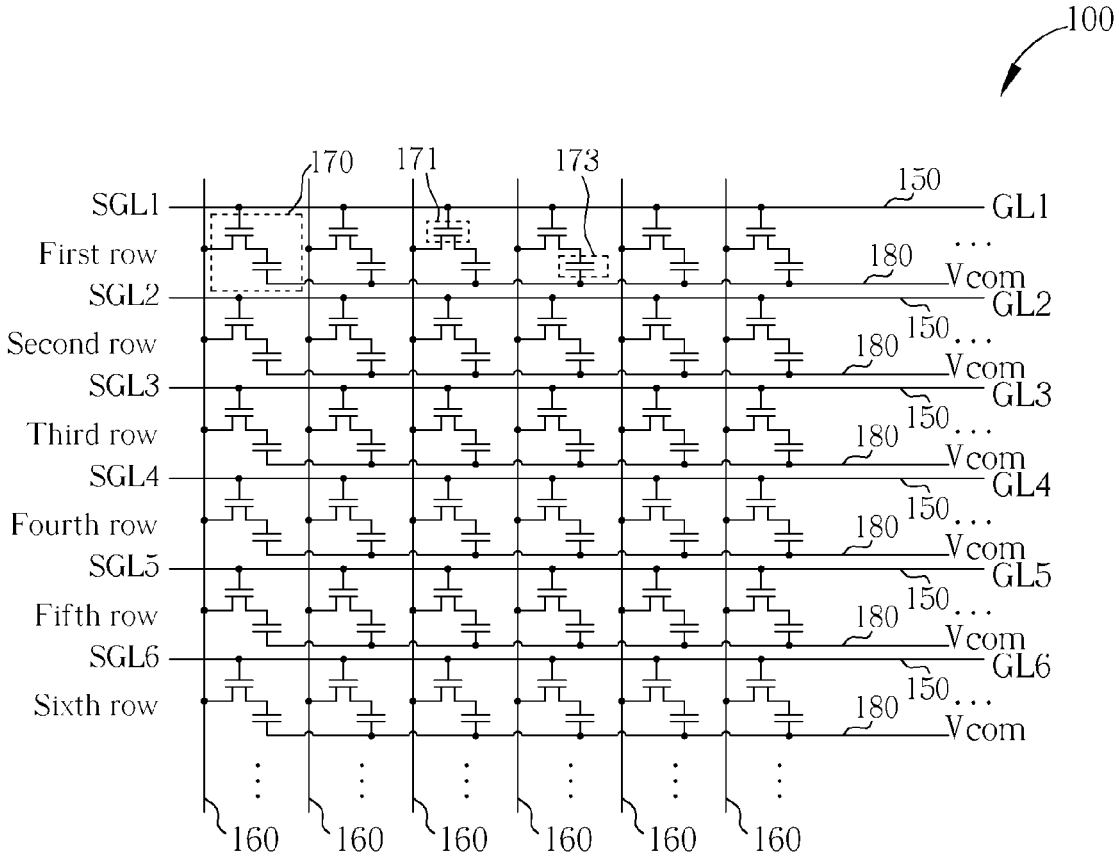
FIG. 1 RELATED ART
FIG. 1 is a schematic diagram showing a prior-art LCD device based on the row-inversion driving operation.
Figure 3:
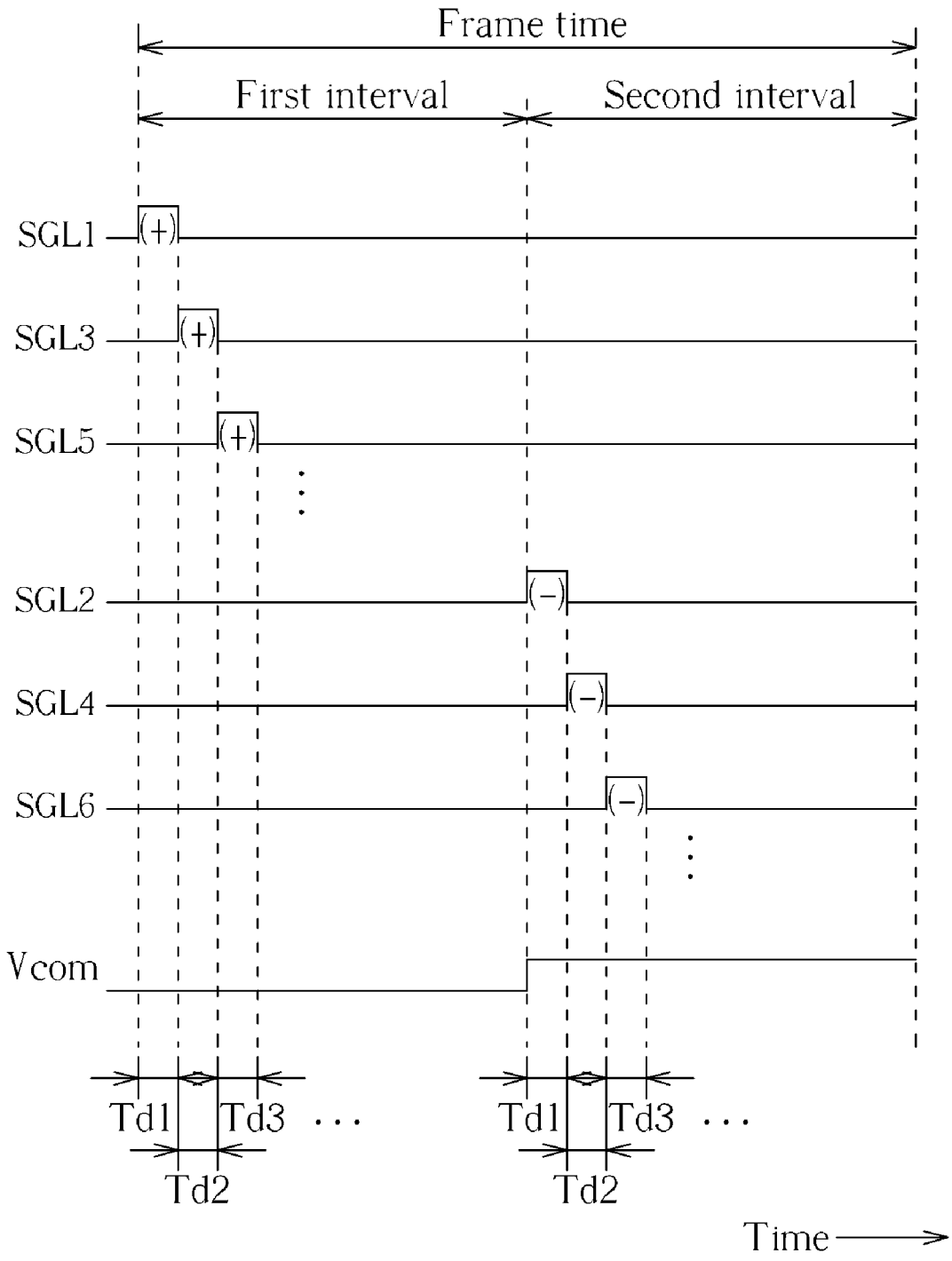
FIG. 3 PRIOR ART
FIG. 3 shows the related signal waveforms regarding the operation of the LCD device in FIG. 1 for generating the Nth frame in FIG. 2 based on a prior-art LCD driving method, having time along the abscissa.
Figure 4:
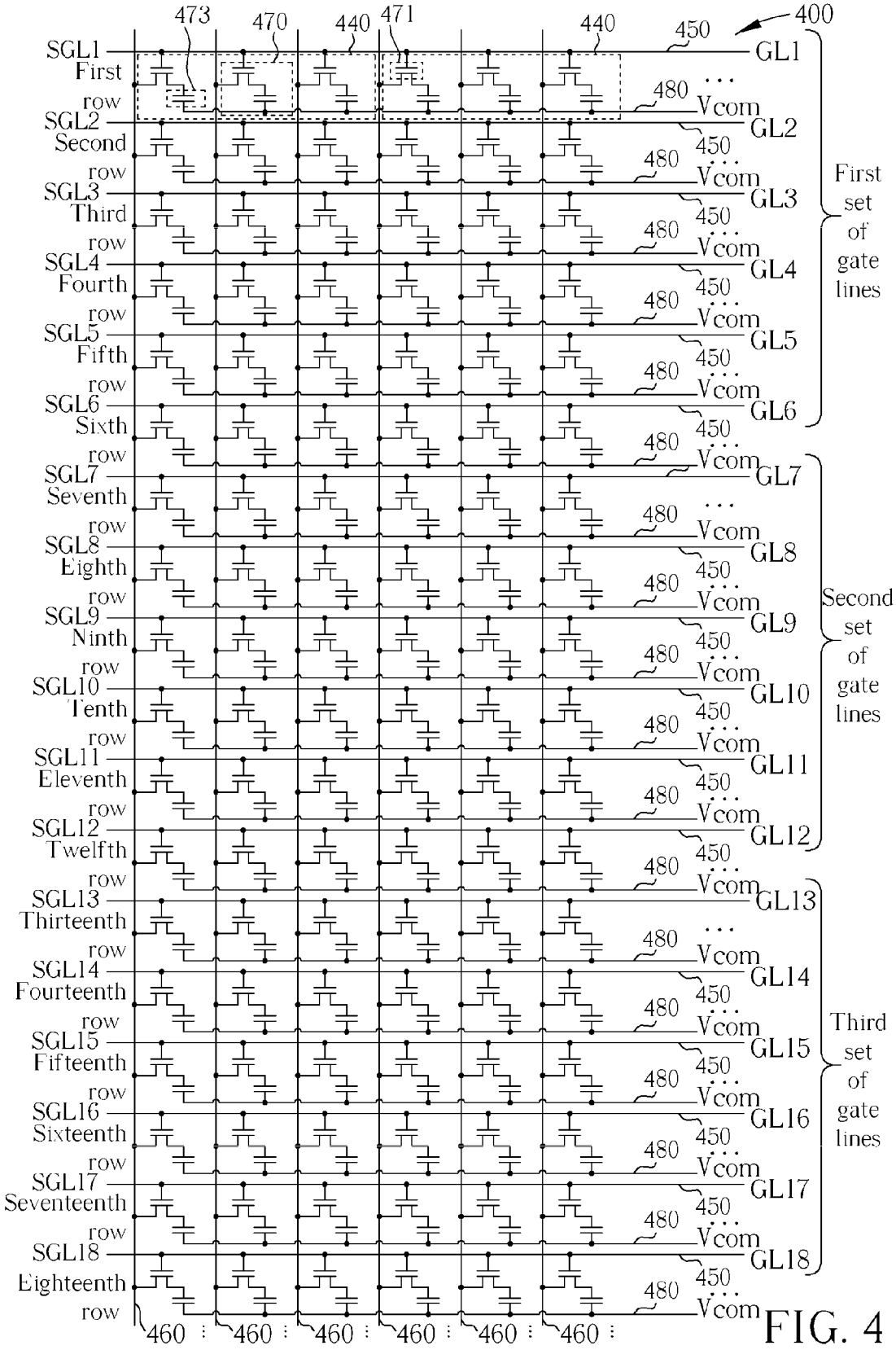
FIG. 4 is a schematic diagram showing an LCD device using row-inversion driving methods of the present invention.

FIG. 4 is a schematic diagram showing an LCD device using row-inversion driving methods of the present invention. As shown in FIG. 4, the LCD device 400 comprises a plurality of data lines 460, a plurality of gate lines 450, a plurality of common lines 480, and a plurality of rows of pixels. For ease of explanation, the LCD device 400 in FIG. 4 illustrates six data lines 460, eighteen common lines 480, and eighteen gate lines 450 (GL1-GL18). All the common lines 480 are furnished with a common voltage Vcom. Each data line 460 is utilized for receiving one corresponding data signal. Each gate line 450 is utilized for receiving one corresponding gate signal. For instance, the first gate line GL1 is utilized for receiving the first gate signal SGL1, the eighteenth gate line GL18 is utilized for receiving the eighteenth gate signal SGL18, and the rest can be inferred by analogy. The plurality of gate lines 450 are divided into a plurality of sets of gate lines. For instance, the eighteen gate lines 450 (GL1-GL18) are divided into a first set of gate lines GL1-GL6, a second set of gate lines GL7-GL12, and a third set of gate lines GL13-

GL18. Each row of pixels comprises a plurality of pixels 440. Each pixel 440 comprises three pixel units 470. Each pixel unit 470 is a red pixel unit, a green pixel unit, or a blue pixel unit. Each pixel unit 470 comprises a data switch 471 and a storage unit 473. The storage unit 473 comprises at least one liquid crystal capacitor and at least one storage capacitor. Each data switch 471 is turned on/off in response to one corresponding gate signal furnished by one corresponding gate line 450. Each data signal is written into one corresponding storage unit 473 via one corresponding data line 460 under the control of one corresponding data switch 471.

Figure 6:
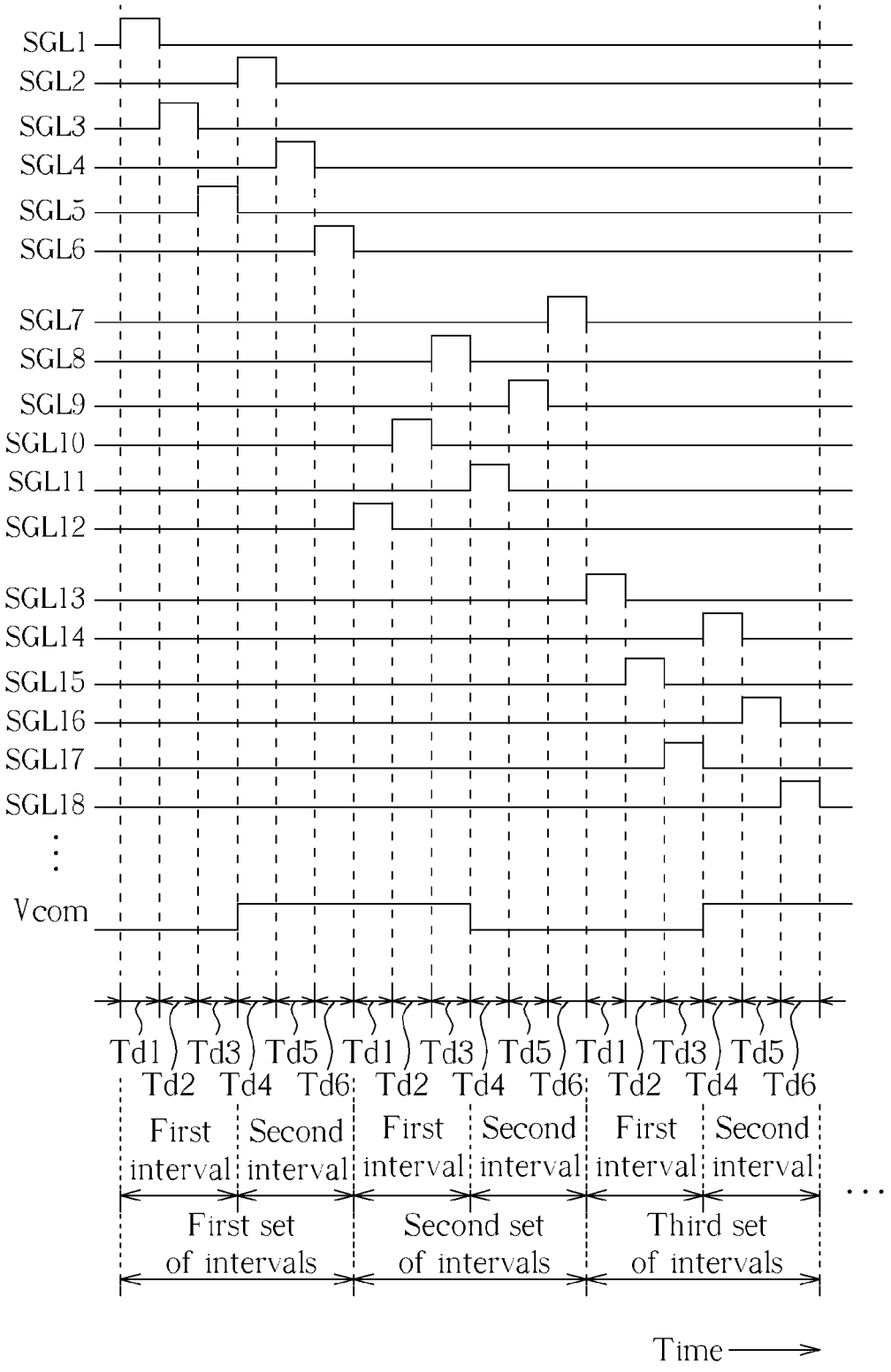
FIG. 6 shows the related signal waveforms of the gate signals and the common voltage regarding the operation of the LCD device in FIG. 4 for generating the Mth frame in FIG. 5 based on the row-inversion driving method in accordance with a first embodiment of the present invention, having time along the abscissa.

FIG. 5 is a schematic diagram showing pixel polarities in the Mth frame illustrated by the LCD device shown in FIG. 4. In the Mth frame 500 shown in FIG. 5, the data signals with positive polarity are written into the pixel units disposed in the odd rows, and the data signals with negative polarity are written into the pixel units disposed in the even rows. FIG. 6 shows the related signal waveforms of the gate signals and the common voltage regarding the operation of the LCD device in FIG. 4 for generating the Mth frame in FIG. 5 based on the row-inversion driving method in accordance with a first embodiment of the present invention, having time along the abscissa. As shown in FIG. 6, the row-inversion driving method of the first embodiment of the present invention divides the frame time for generating the Mth frame 500 into a plurality of sets of intervals. Each set of intervals comprises a first interval and a second interval. The first and second intervals are further divided into a plurality of sub-intervals Td1-Td3 and Td4-Td6 respectively.

As shown in FIG. 6, the common voltage Vcom is set to be a first voltage, e.g. a low voltage in the embodiment, during the first interval of the first set of intervals, the second interval of the second set of intervals and the first interval of the third set of intervals. The common voltage Vcom is set to be a second voltage, e.g. a high voltage in the embodiment, during the second interval of the first set of intervals, the first interval of the second set of intervals and the second interval of the third set of intervals.

In the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity sequentially into the pixel units 470 of the first, third and fifth rows of pixels. In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity sequentially into the pixel units 470 of the second, fourth and sixth rows of pixels.

In the write operation during the consecutive sub-intervals Td1-Td3 of the first interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity sequentially into the pixel units 470 of the twelfth, tenth and eighth rows of pixels. In the write operation during the consecutive sub-intervals Td4-Td6 of the second interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity sequentially into the pixel units 470 of the eleventh, ninth and seventh rows of pixels.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity sequentially into the pixel units 470 of the thirteenth, fifteenth and seventeenth rows of pixels. In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity sequentially into the pixel units 470 of the fourteenth, sixteenth and eighteenth rows of pixels.

In the aforementioned row-inversion driving method in accordance with the first embodiment of the present invention, the enabling sequences of adjacent sets of gate lines are opposite to each other. That is, the gate signal enabling process is operated based on an interlace-commutate scanning process. Accordingly, the data signals of the pixel units at edges of adjacent sets of gate lines suffers same amount of voltage drifting. That is, the band mura effect occurring to the data signals of the pixel units at edges of adjacent sets of gate lines can be suppressed for improving display quality. It is noted that although each set of gate lines of the LCD device 400 comprises six gate lines as shown in FIG. 4, the LCD driving method of the present invention is not limited to drive LCD devices having gate lines divided into sets of six gate lines. In other words, the LCD driving method of the present invention can be utilized to drive LCD devices having gate lines divided into sets of a plurality of gate lines, which is also applied to other embodiments described below.

Furthermore, in the (M+1)th frame generated by the row-inversion driving method in accordance with the first embodiment of the present invention, the polarity of data signal of each pixel unit is opposite to the polarity of data signal of one corresponding pixel unit in the Mth frame 500. That is, in the driving operation for generating the (M+1)th frame, the first and second voltages of the common voltage Vcom are set to be the high and low voltages respectively, and the data signals having negative and positive polarities are written based on the first and second voltages of the common voltage Vcom respectively.

Figure 7:
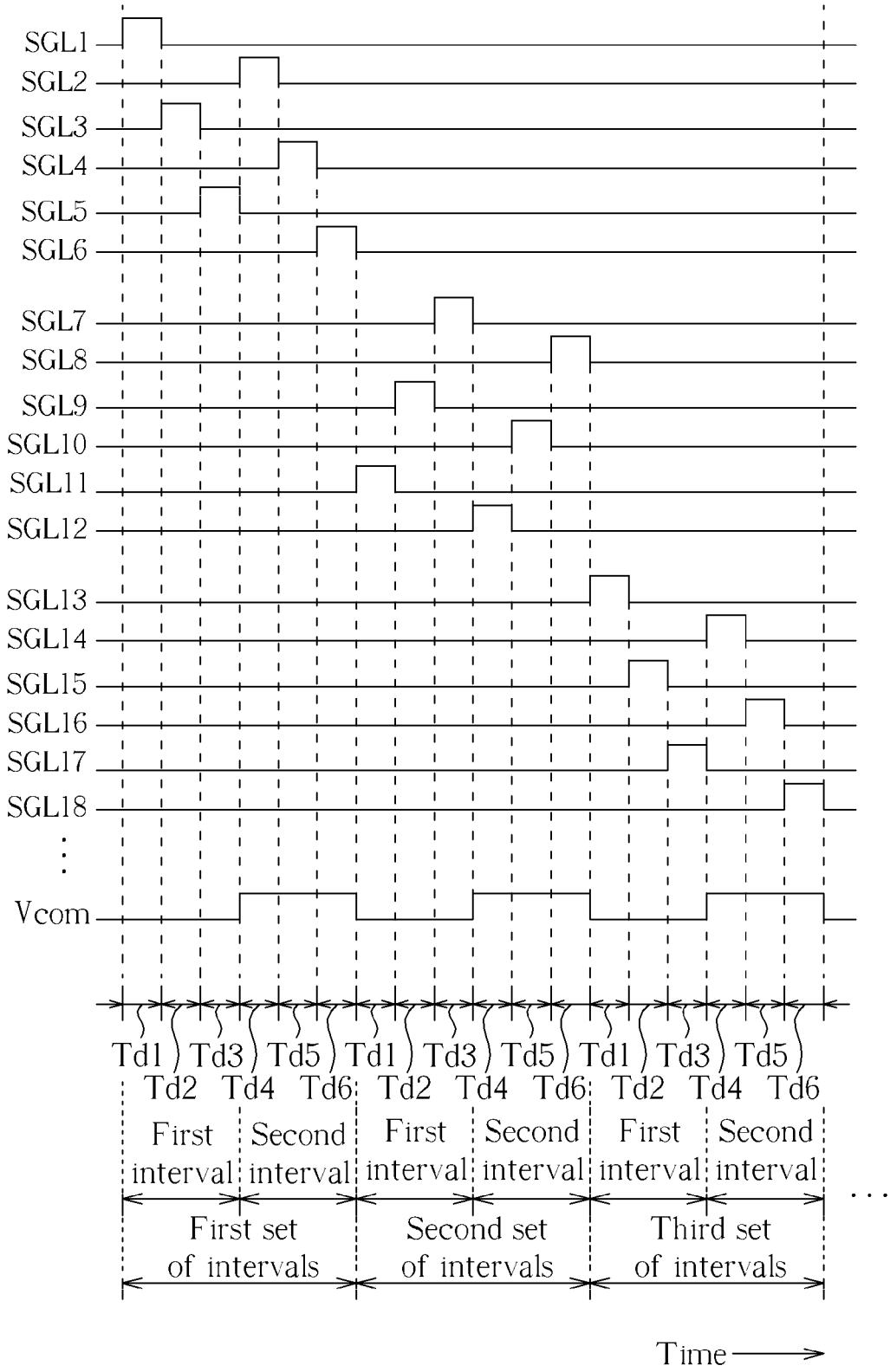
FIG. 7 shows the related signal waveforms of the gate signals and the common voltage regarding the operation of the LCD device in FIG. 4 for generating the Mth frame in FIG. 5 based on the row-inversion driving method in accordance with a second embodiment of the present invention, having time along the abscissa.

FIG. 7 shows the related signal waveforms of the gate signals and the common voltage regarding the operation of the LCD device in FIG. 4 for generating the Mth frame in FIG. 5 based on the row-inversion driving method in accordance with a second embodiment of the present invention, having time along the abscissa. As shown in FIG. 7, the row-inversion driving method of the second embodiment of the present invention divides the frame time for generating the Mth frame 500 into a plurality of sets of intervals. Each set of intervals comprises a first interval and a second interval. The first and second intervals are further divided respectively into a plurality of sub-intervals Td1-Td3 and a plurality of sub-intervals Td4-Td6.

As shown in FIG. 7, the common voltage Vcom is set to be a first voltage, e.g. a low voltage in the embodiment, during the first interval of the first set of intervals, the first interval of the second set of intervals and the first interval of the third set of intervals. The common voltage Vcom is set to be a second voltage, e.g. a high voltage in the embodiment, during the second interval of the first set of intervals, the second interval of the second set of intervals and the second interval of the third set of intervals.

In the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity sequentially into the pixel units 470 of the first, third and fifth rows of pixels. In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity sequentially into the pixel units 470 of the second, fourth and sixth rows of pixels.

In the write operation during the consecutive sub-intervals Td1-Td3 of the first interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity sequentially into the pixel units 470 of the eleventh, ninth and seventh rows of pixels. In the write operation during the consecutive sub-intervals Td4-Td6 of the second interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity sequentially into the pixel units 470 of the twelfth, tenth and eighth rows of pixels.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity sequentially into the pixel units 470 of the thirteenth, fifteenth and seventeenth rows of pixels. In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity sequentially into the pixel units 470 of the fourteenth, sixteenth and eighteenth rows of pixels.

In the aforementioned row-inversion driving method in accordance with the second embodiment of the present invention, the enabling sequences of adjacent sets of gate lines are opposite to each other. That is, the gate signal enabling process is operated based on an interlace-commutate scanning process. Accordingly, the band mura effect occurring to the data signals of the pixel units at edges of adjacent sets of gate lines can be suppressed for improving display quality. Similarly, in the (M+1)th frame generated by the row-inversion driving method in accordance with the second embodiment of the present invention, the polarity of data signal of each pixel unit is opposite to the polarity of data signal of one corresponding pixel unit in the Mth frame 500. That is, in the driving operation for generating the (M+1)th frame, the first and second voltages of the common voltage Vcom are set to be the high and low voltages respectively, and the data signals having negative and positive polarities are written based on the first and second voltages of the common voltage Vcom respectively.

Figure 8:
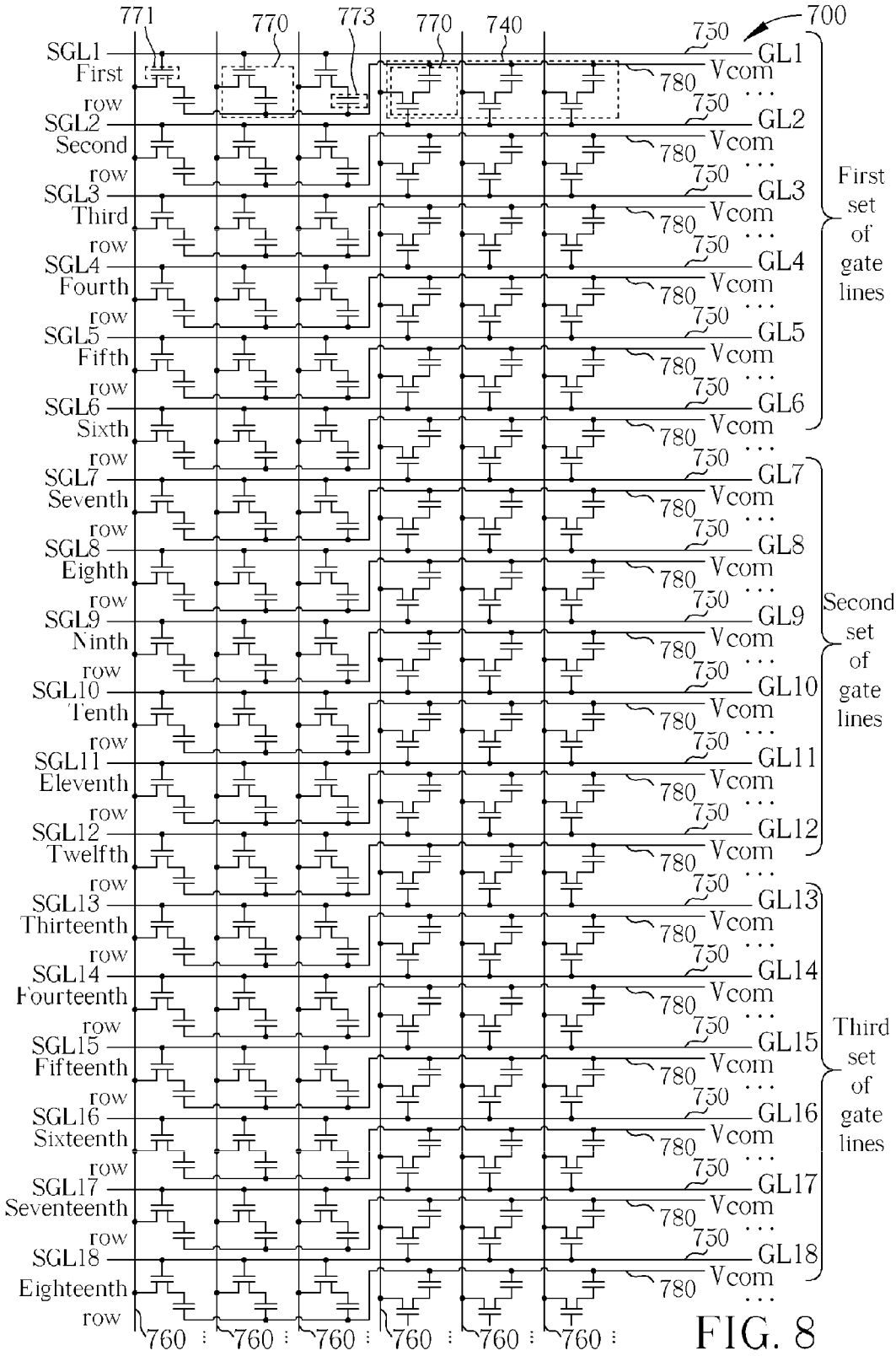
FIG. 8 is a schematic diagram showing an LCD device using pixel-inversion driving methods of the present invention.

FIG. 8 is a schematic diagram showing an LCD device using pixel-inversion driving methods of the present invention. As shown in FIG. 8, the LCD device 700 comprises a plurality of data lines 760, a plurality of gate lines 750, a plurality of common lines 780, and a plurality of rows of pixels. For ease of explanation, the LCD device 700 in FIG. 8 illustrates six data lines 760, eighteen common lines 780, and eighteen gate lines 750 (GL1-GL18). All the common lines 780 are furnished with a common voltage Vcom. Each data line 760 is utilized for receiving one corresponding data signal. Each gate line 750 is utilized for receiving one corresponding gate signal. The plurality of gate lines 750 are divided into a plurality of sets of gate lines. For instance, the eighteen gate lines 750 (GL1-GL18) are divided into a first set of gate lines GL1-GL6, a second set of gate lines GL7-GL12, and a third set of gate lines GL13-GL18. Each row of pixels comprises a plurality of pixels 740. Each pixel 740 comprises three pixel units 770. Each pixel unit 770 is a red pixel unit, a green pixel unit, or a blue pixel unit. Each pixel unit 770 comprises a data switch 771 and a storage unit 773. The storage unit 773 comprises at least one liquid crystal capacitor and at least one storage capacitor.

Each data switch 771 comprises a first end coupled to one corresponding data line 760, a second end coupled to one corresponding storage unit 773, and a gate coupled to one corresponding gate line 750. For instance, in the first row of pixels, the gate of the data switch 771 of each pixel unit 770 in odd pixels 740 is coupled to the first gate line GL1, and the gate of the data switch 771 of each pixel unit 770 in even pixels 740 is coupled to the second gate line GL2. In the second row of pixels, the gate of the data switch 771 of each pixel unit 770 in odd pixels 740 is coupled to the second gate line GL2, and the gate of the data switch 771 of each pixel unit 770 in even pixels 740 is coupled to the third gate line GL3. Each data signal is written into one corresponding storage unit 773 via one corresponding data line 760 under the control of one corresponding data switch 771.

FIG. 9 is a schematic diagram showing pixel polarities in the Ith frame illustrated by the LCD device shown in FIG. 8. In the Ith frame 800 shown in FIG. 9, the data signals with positive polarity are written into the pixel units of the odd pixels disposed in odd rows and the pixel units of the even pixels disposed in even rows, and the data signals with negative polarity are written into the pixel units of the even pixels disposed in odd rows and the pixel units of the odd pixels disposed in even rows. Referring to FIG. 6, the related signal waveforms of the gate signals and the common voltage for generating the Ith frame 800 in FIG. 9 based on the pixel-inversion driving method in accordance with a third embodiment of the present invention are the same as the signal waveforms shown in FIG. 6.

FIG. 10 presents a process list depicting the related writing operations for generating the Ith frame in FIG. 9 based on the related signal waveforms in FIG. 6. As shown in FIG. 6 and FIG. 10, the common voltage Vcom is set to be a first voltage, e.g. a low voltage in the embodiment, during the first interval of the first set of intervals, the second interval of the second set of intervals and the first interval of the third set of intervals. The common voltage Vcom is set to be a second voltage, e.g. a high voltage in the embodiment, during the second interval of the first set of intervals, the first interval of the second set of intervals and the second interval of the third set of intervals.

As shown in FIG. 6 and FIG. 10, in the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels. For instance, in the write operation during the sub-interval Td2 of the first interval of the first set of intervals, the gate signal SGL3 of the odd gate line GL3 is enabled for writing the data signals with positive polarity into the pixel units 770 of the odd pixels 740 in the third row of pixels and also for writing the data signals with positive polarity into the pixel units 770 of the even pixels 740 in the second row of pixels.

In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels. For instance, in the write operation during the sub-interval Td5 of the second interval of the first set of intervals, the gate signal SGL4 of the even gate line GL4 is enabled for writing the data signals with negative polarity into the pixel units 770 of the odd pixels 740 in the fourth row of pixels and also for writing the data signals with negative polarity into the pixel units 770 of the even pixels 740 in the third row of pixels.

In the write operation during the consecutive sub-intervals Td1-Td3 of the first interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels. For instance, in the write operation during the sub-interval Td2 of the first interval of the second set of intervals, the gate signal SGL10 of the even gate line GL10 is enabled for writing the data signals with negative polarity into the pixel units 770 of the odd pixels 740 in the tenth row of pixels and also for writing the data signals with negative polarity into the pixel units 770 of the even pixels 740 in the ninth row of pixels.

In the write operation during the consecutive sub-intervals Td4-Td6 of the second interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels. For instance, in the write operation during the sub-interval Td5 of the second interval of the second set of intervals, the gate signal SGL9 of the odd gate line GL9 is enabled for writing the data signals with positive polarity into the pixel units 770 of the odd pixels 740 in the ninth row of pixels and also for writing the data signals with positive polarity into the pixel units 770 of the even pixels 740 in the eighth row of pixels.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels.

In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels.

It is noted that although only the pixel units 770 of the odd pixels 740 in the first row of pixels are written with the data signals having positive polarity during the sub-interval Td1 of the first interval of the first set of intervals, the write operation during the sub-interval Td1 of the first interval of the first set of intervals may further comprise writing the data signals with positive polarity into the pixel units 770 of the even pixels 740 in the last row of pixels, i.e. an even row of pixels, or an auxiliary row of pixels. In the aforementioned pixel-inversion driving method in accordance with the third embodiment of the present invention, the enabling sequences of adjacent sets of gate lines are opposite to each other. That is, the gate signal enabling process is operated based on an interlace-commutate scanning process. Accordingly, the band mura effect occurring to the data signals of the pixel units at edges of adjacent sets of gate lines can be suppressed for improving display quality.

Furthermore, in the (I+1)th frame generated by the pixel-inversion driving method in accordance with the third embodiment of the present invention, the polarity of data signal of each pixel unit is opposite to the polarity of data signal of one corresponding pixel unit in the Ith frame 800. That is, in the driving operation for generating the (I+1)th frame, the first and second voltages of the common voltage Vcom are set to be the high and low voltages respectively, and the data signals having negative and positive polarities are written based on the first and second voltages of the common voltage Vcom respectively.

Referring to FIG. 7, the related signal waveforms of the gate signals and the common voltage for generating the Ith frame 800 in FIG. 9 based on the pixel-inversion driving method in accordance with a fourth embodiment of the present invention are the same as the signal waveforms shown in FIG. 7. FIG. 11 presents a process list depicting the related writing operations for generating the Ith frame in FIG. 9 based on the related signal waveforms in FIG. 7. As shown in FIG. 7 and FIG. 11, the common voltage Vcom is set to be a first voltage, e.g. a low voltage in the embodiment, during the first interval of the first set of intervals, the first interval of the second set of intervals and the first interval of the third set of intervals. The common voltage Vcom is set to be a second voltage, e.g. a high voltage in the embodiment, during the second interval of the first set of intervals, the second interval of the second set of intervals and the second interval of the third set of intervals.

As shown in FIG. 7 and FIG. 11, in the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels. In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels.

In the write operation during the consecutive sub-intervals Td1-Td3 of the first interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels. In the write operation during the consecutive sub-intervals Td4-Td6 of the second interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity into the pixel units 770 of the odd pixels 740 in the corresponding odd rows of pixels and also for writing the data signals with positive polarity into the pixel units 770 of the even pixels 740 in the corresponding even rows of pixels. In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity into the pixel units 770 of the odd pixels 740 in the corresponding even rows of pixels and also for writing the data signals with negative polarity into the pixel units 770 of the even pixels 740 in the corresponding odd rows of pixels.

It is noted that although only the pixel units 770 of the odd pixels 740 in the first row of pixels are written with the data signals having positive polarity during the sub-interval Td1 of the first interval of the first set of intervals, the write operation during the sub-interval Td1 of the first interval of the first set of intervals may further comprise writing the data signals with positive polarity into the pixel units 770 of the even pixels 740 in the last row of pixels, i.e. an even row of pixels, or an auxiliary row of pixels. In the aforementioned pixel-inversion driving method in accordance with the fourth embodiment of the present invention, the enabling sequences of adjacent sets of gate lines are opposite to each other. That is, the gate signal enabling process is operated based on an interlace-commutate scanning process. Accordingly, the band mura effect occurring to the data signals of the pixel units at edges of adjacent sets of gate lines can be suppressed for improving display quality.

Similarly, in the (I+1)th frame generated by the pixel-inversion driving method in accordance with the fourth embodiment of the present invention, the polarity of data signal of each pixel unit is opposite to the polarity of data signal of one corresponding pixel unit in the Ith frame 800. That is, in the driving operation for generating the (I+1)th frame, the first and second voltages of the common voltage Vcom are set to be the high and low voltages respectively, and the data signals having negative and positive polarities are written based on the first and second voltages of the common voltage Vcom respectively.

Figure 12:
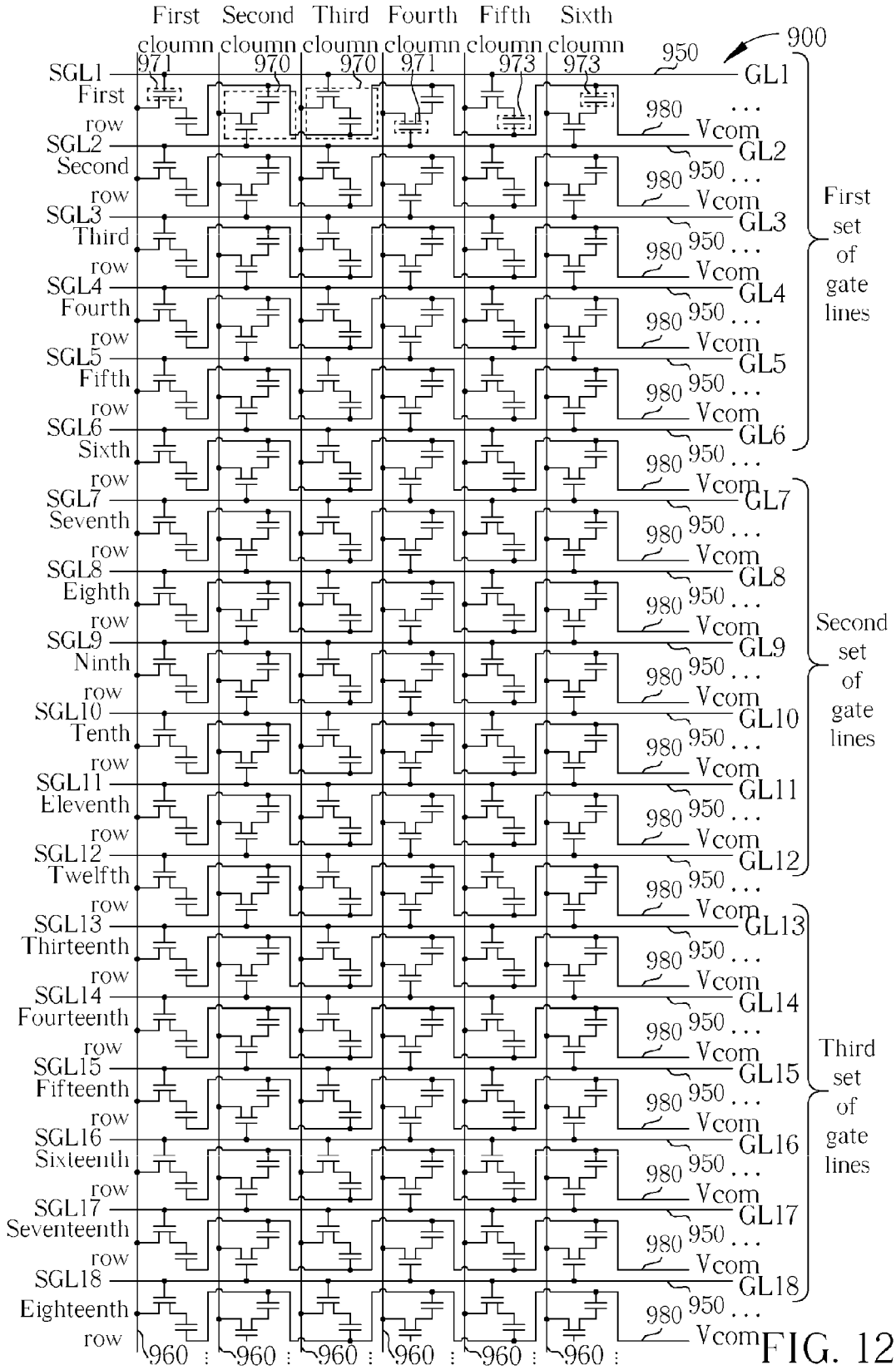
FIG. 12 is a schematic diagram showing an LCD device using dot-inversion driving methods of the present invention.

FIG. 12 is a schematic diagram showing an LCD device using dot-inversion driving methods of the present invention. As shown in FIG. 12, the LCD device 900 comprises a plurality of data lines 960, a plurality of gate lines 950, a plurality of common lines 980, and a plurality of rows of pixel units. For ease of explanation, the LCD device 900 in FIG. 12 illustrates six data lines 960, eighteen common lines 980, and eighteen gate lines 950 (GL1-GL18). All the common lines 980 are furnished with a common voltage Vcom. Each data line 960 is utilized for receiving one corresponding data signal. Each gate line 950 is utilized for receiving one corresponding gate signal. The plurality of gate lines 950 are divided into a plurality of sets of gate lines. For instance, the eighteen gate lines 950 (GL1-GL18) are divided into a first set of gate lines GL1-GL6, a second set of gate lines GL7-GL12, and a third set of gate lines GL13-GL18. Each row of pixel units comprises a plurality of pixel units 970. Each pixel unit 970 is a red pixel unit, a green pixel unit, or a blue pixel unit. Each pixel unit 970 comprises a data switch 971 and a storage unit 973. The storage unit 973 comprises at least one liquid crystal capacitor and at least one storage capacitor.

Each data switch 971 comprises a first end coupled to one corresponding data line 960, a second end coupled to one corresponding storage unit 973, and a gate coupled to one corresponding gate line 950. For instance, in the first row of pixel units, the gate of the data switch 971 of each odd pixel unit 970 is coupled to the first gate line GL1, and the gate of the data switch 971 of each even pixel unit 970 is coupled to the second gate line GL2. In the second row of pixel units, the gate of the data switch 971 of each odd pixel unit 970 is coupled to the second gate line GL2, and the gate of the data switch 971 of each even pixel unit 970 is coupled to the third gate line GL3. Each data signal is written into one corresponding storage unit 973 via one corresponding data line 960 under the control of one corresponding data switch 971.

FIG. 13 is a schematic diagram showing pixel polarities in the Lth frame illustrated by the LCD device shown in FIG. 12. In the Lth frame 990 shown in FIG. 13, the data signals with positive polarity are written into the odd pixel units disposed in odd rows and the even pixel units disposed in even rows, and the data signals with negative polarity are written into the even pixel units disposed in odd rows and the odd pixel units disposed in even rows. The odd pixel units are corresponding to the odd columns, and the even pixel units are corresponding to the even columns. The related signal waveforms of the gate signals and the common voltage for generating the Lth frame 990 in FIG. 13 based on the dot-inversion driving method in accordance with a fifth embodiment of the present invention are the same as the signal waveforms shown in FIG. 6.

FIG. 14 presents a process list depicting the related writing operations for generating the Lth frame in FIG. 13 based on the related signal waveforms in FIG. 6. As shown in FIG. 6 and FIG. 14, the common voltage Vcom is set to be a first voltage, e.g. a low voltage in the embodiment, during the first interval of the first set of intervals, the second interval of the second set of intervals and the first interval of the third set of intervals. The common voltage Vcom is set to be a second voltage, e.g. a high voltage in the embodiment, during the second interval of the first set of intervals, the first interval of the second set of intervals and the second interval of the third set of intervals.

As shown in FIG. 6 and FIG. 14, in the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity into the odd pixel units 970 in the corresponding odd rows of pixel units and also for writing the data signals with positive polarity into the even pixel units 970 in the corresponding even rows of pixel units. In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity into the odd pixel units 970 in the corresponding even rows of pixel units and also for writing the data signals with negative polarity into the even pixel units 970 in the corresponding odd rows of pixel units.

In the write operation during the consecutive sub-intervals Td1-Td3 of the first interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity into the odd pixel units 970 in the corresponding even rows of pixel units and also for writing the data signals with negative polarity into the even pixel units 970 in the corresponding odd rows of pixel units. In the write operation during the consecutive sub-intervals Td4-Td6 of the second interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity into the odd pixel units 970 in the corresponding odd rows of pixel units and also for writing the data signals with positive polarity into the even pixel units 970 in the corresponding even rows of pixel units.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity into the odd pixel units 970 in the corresponding odd rows of pixel units and also for writing the data signals with positive polarity into the even pixel units 970 in the corresponding even rows of pixel units. In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity into the odd pixel units 970 in the corresponding even rows of pixel units and also for writing the data signals with negative polarity into the even pixel units 970 in the corresponding odd rows of pixel units.

It is noted that although only the odd pixel units 970 in the first row of pixel units are written with the data signals having positive polarity during the sub-interval TD1 of the first interval of the first set of intervals, the write operation during the sub-interval Td1 of the first interval of the first set of intervals may further comprise writing the data signals with positive polarity into the even pixel units 970 in the last row of pixel units, i.e. an even row of pixel units, or an auxiliary row of pixel units. In the aforementioned dot-inversion driving method in accordance with the fifth embodiment of the present invention, the enabling sequences of adjacent sets of gate lines are opposite to each other. That is, the gate signal enabling process is operated based on an interlace-commutate scanning process. Accordingly, the band mura effect occurring to the data signals of the pixel units at edges of adjacent sets of gate lines can be suppressed for improving display quality.

Furthermore, in the (L+1)th frame generated by the dot-inversion driving method in accordance with the fifth embodiment of the present invention, the polarity of data signal of each pixel unit is opposite to the polarity of data signal of one corresponding pixel unit in the Lth frame 990. That is, in the driving operation for generating the (L+1)th frame, the first and second voltages of the common voltage Vcom are set to be the high and low voltages respectively, and the data signals having negative and positive polarities are written based on the first and second voltages of the common voltage Vcom respectively.

The related signal waveforms of the gate signals and the common voltage for generating the Lth frame 990 in FIG. 13 based on the dot-inversion driving method in accordance with a sixth embodiment of the present invention are the same as the signal waveforms shown in FIG. 7. FIG. 15 presents a process list depicting the related writing operations for generating the Lth frame in FIG. 13 based on the related signal waveforms in FIG. 7. As shown in FIG. 7 and FIG. 15, the common voltage Vcom is set to be a first voltage, e.g. a low voltage in the embodiment, during the first interval of the first set of intervals, the first interval of the second set of intervals and the first interval of the third set of intervals. The common voltage Vcom is set to be a second voltage, e.g. a high voltage in the embodiment, during the second interval of the first set of intervals, the second interval of the second set of intervals and the second interval of the third set of intervals.

As shown in FIG. 7 and FIG. 15, in the write operation during the consecutive sub-intervals Td1-Td3 of the first interval of the first set of intervals, the gate signals SGL1, SGL3 and SGL5 of the odd gate lines GL1, GL3 and GL5 of the first set of gate lines are sequentially enabled, i.e. in ascending order, for writing the data signals with positive polarity into the odd pixel units 970 in the corresponding odd rows of pixel units and also for writing the data signals with positive polarity into the even pixel units 970 in the corresponding even rows of pixel units. In the write operation during the consecutive sub-intervals Td4-Td6 of the second interval of the first set of intervals, the gate signals SGL2, SGL4 and SGL6 of the even gate lines GL2, GL4 and GL6 of the first set of gate lines are sequentially enabled, i.e. in ascending order, for writing the data signals with negative polarity into the odd pixel units 970 in the corresponding even rows of pixel units and also for writing the data signals with negative polarity into the even pixel units 970 in the corresponding odd rows of pixel units.

In the write operation during the consecutive sub-intervals Td1-Td3 of the first interval of the second set of intervals, the gate signals SGL11, SGL9 and SGL7 of the odd gate lines GL11, GL9 and GL7 of the second set of gate lines are sequentially enabled, i.e. in descending order, for writing the data signals with positive polarity into the odd pixel units 970 in the corresponding odd rows of pixel units and also for writing the data signals with positive polarity into the even pixel units 970 in the corresponding even rows of pixel units. In the write operation during the consecutive sub-intervals Td4-Td6 of the second interval of the second set of intervals, the gate signals SGL12, SGL10 and SGL8 of the even gate lines GL12, GL10 and GL8 of the second set of gate lines are sequentially enabled, i.e. in descending order, for writing the data signals with negative polarity into the odd pixel units 970 in the corresponding even rows of pixel units and also for writing the data signals with negative polarity into the even pixel units 970 in the corresponding odd rows of pixel units.

In the write operation during the consecutive sub-intervals Td1-Td3 of the first interval of the third set of intervals, the gate signals SGL13, SGL15 and SGL17 of the odd gate lines GL13, GL15 and GL17 of the third set of gate lines are sequentially enabled, i.e. in ascending order, for writing the data signals with positive polarity into the odd pixel units 970 in the corresponding odd rows of pixel units and also for writing the data signals with positive polarity into the even pixel units 970 in the corresponding even rows of pixel units. In the write operation during the consecutive sub-intervals Td4-Td6 of the second interval of the third set of intervals, the gate signals SGL14, SGL16 and SGL18 of the even gate lines GL14, GL16 and GL18 of the third set of gate lines are sequentially enabled, i.e. in ascending order, for writing the data signals with negative polarity into the odd pixel units 970 in the corresponding even rows of pixel units and also for writing the data signals with negative polarity into the even pixel units 970 in the corresponding odd rows of pixel units.

It is noted that although only the odd pixel units 970 in the first row of pixel units are written with the data signals having positive polarity during the sub-interval TD1 of the first interval of the first set of intervals, the write operation during the sub-interval Td1 of the first interval of the first set of intervals may further comprise writing the data signals with positive polarity into the even pixel units 970 in the last row of pixel units, i.e. an even row of pixel units, or an auxiliary row of pixel units. In the aforementioned dot-inversion driving method in accordance with the sixth embodiment of the present invention, the enabling sequences of adjacent sets of gate lines are opposite to each other. That is, the gate signal enabling process is operated based on an interlace-commutate scanning process. Accordingly, the band mura effect occurring to the data signals of the pixel units at edges of adjacent sets of gate lines can be suppressed for improving display quality.

Similarly, in the (L+1)th frame generated by the dot-inversion driving method in accordance with the sixth embodiment of the present invention, the polarity of data signal of each pixel unit is opposite to the polarity of data signal of one corresponding pixel unit in the Lth frame 990. That is, in the driving operation for generating the (L+1)th frame, the first and second voltages of the common voltage Vcom are set to be the high and low voltages respectively, and the data signals having negative and positive polarities are written based on the first and second voltages of the common voltage Vcom respectively.

Figure 16:
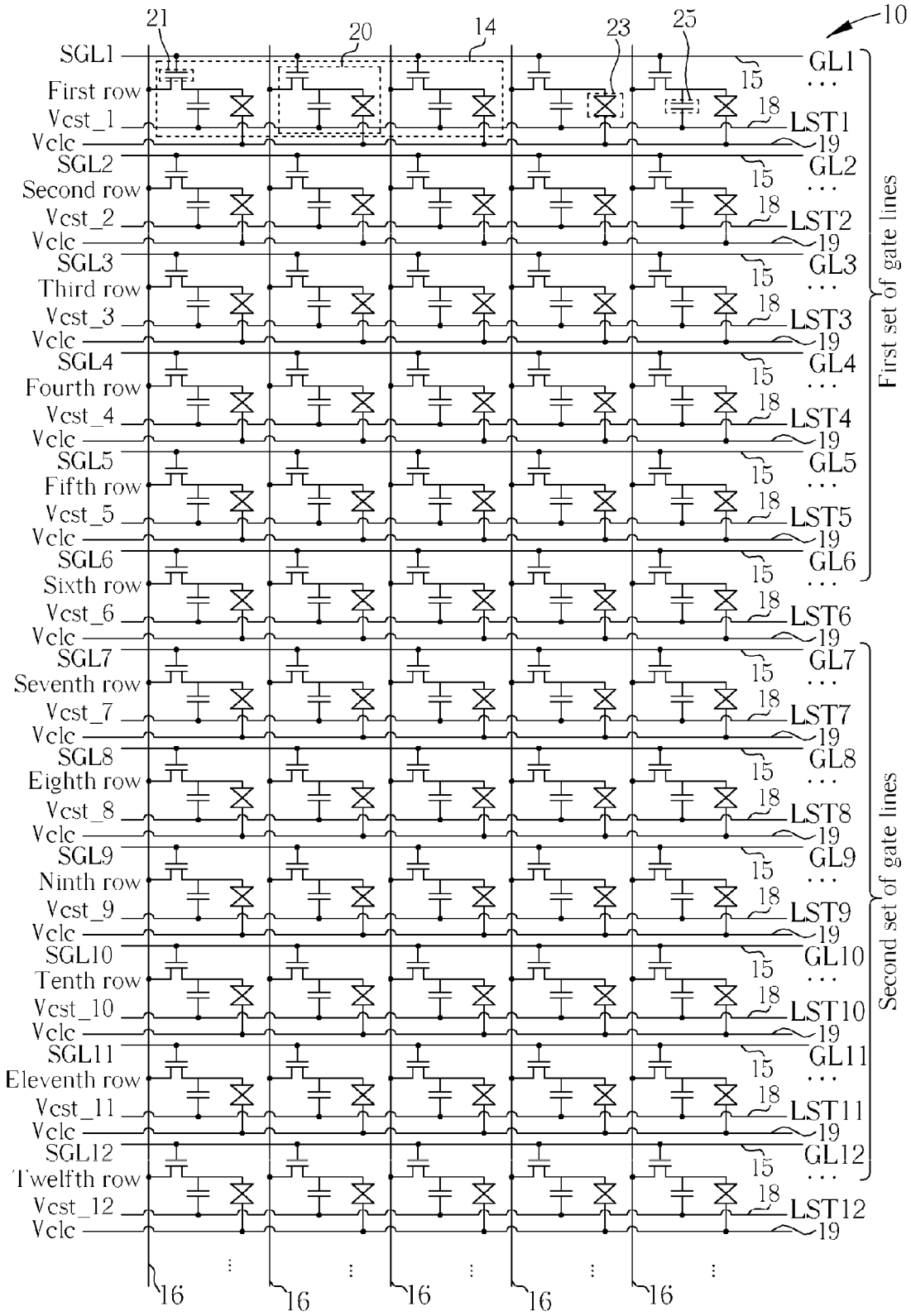
FIG. 16 is a schematic diagram showing another LCD device using the row-inversion driving method of the present invention.

FIG. 16 is a schematic diagram showing another LCD device using the row-inversion driving method of the present invention. As shown in FIG. 16, the LCD device 10 comprises a plurality of data lines 16, a plurality of gate lines 15, a plurality of storage capacitor common lines 18, a plurality of liquid-crystal capacitor common lines 19, and a plurality of rows of pixels. The plurality of gate lines 15 are divided into a plurality of sets of gate lines. Also, the plurality of storage capacitor common lines 18 are divided into a plurality of sets of storage capacitor common lines. In one embodiment shown in the LCD device 10, each set of gate lines comprises six consecutive gate lines 15, and each set of storage capacitor common lines comprises six consecutive storage capacitor common lines 18. For instance, the first set of gate lines comprises six gate lines GL1-GL6, and the second set of gate lines comprises six gate lines GL7-GL12. Similarly, the first set of storage capacitor common lines comprises six storage capacitor common lines LST1-LST6, and the second set of storage capacitor common lines comprises six storage capacitor common lines LST7-LST12. Each row of pixels comprises a plurality of pixels 14. Each pixel 14 comprises three pixel units 20. Each pixel unit 20 is a red pixel unit, a green pixel unit, or a green pixel unit. Each pixel unit 20 comprises a data switch 21, a liquid-crystal capacitor 23, and a storage capacitor 25. Each liquid-crystal capacitor 23 is coupled to one corresponding liquid-crystal capacitor common line 19 for receiving the liquid-crystal capacitor common voltage Vclc. The storage capacitors 25 of the same row are coupled to the same storage capacitor common line 18 for receiving one corresponding storage capacitor common voltage. For instance, the storage capacitors 25 of the first row are coupled to the storage capacitor common line LST1 for receiving the storage capacitor common voltage Vcst_1, and the storage capacitors 25 of the third row are coupled to the storage capacitor common line LST3 for receiving the storage capacitor common voltage Vcst_3.

Figure 17:
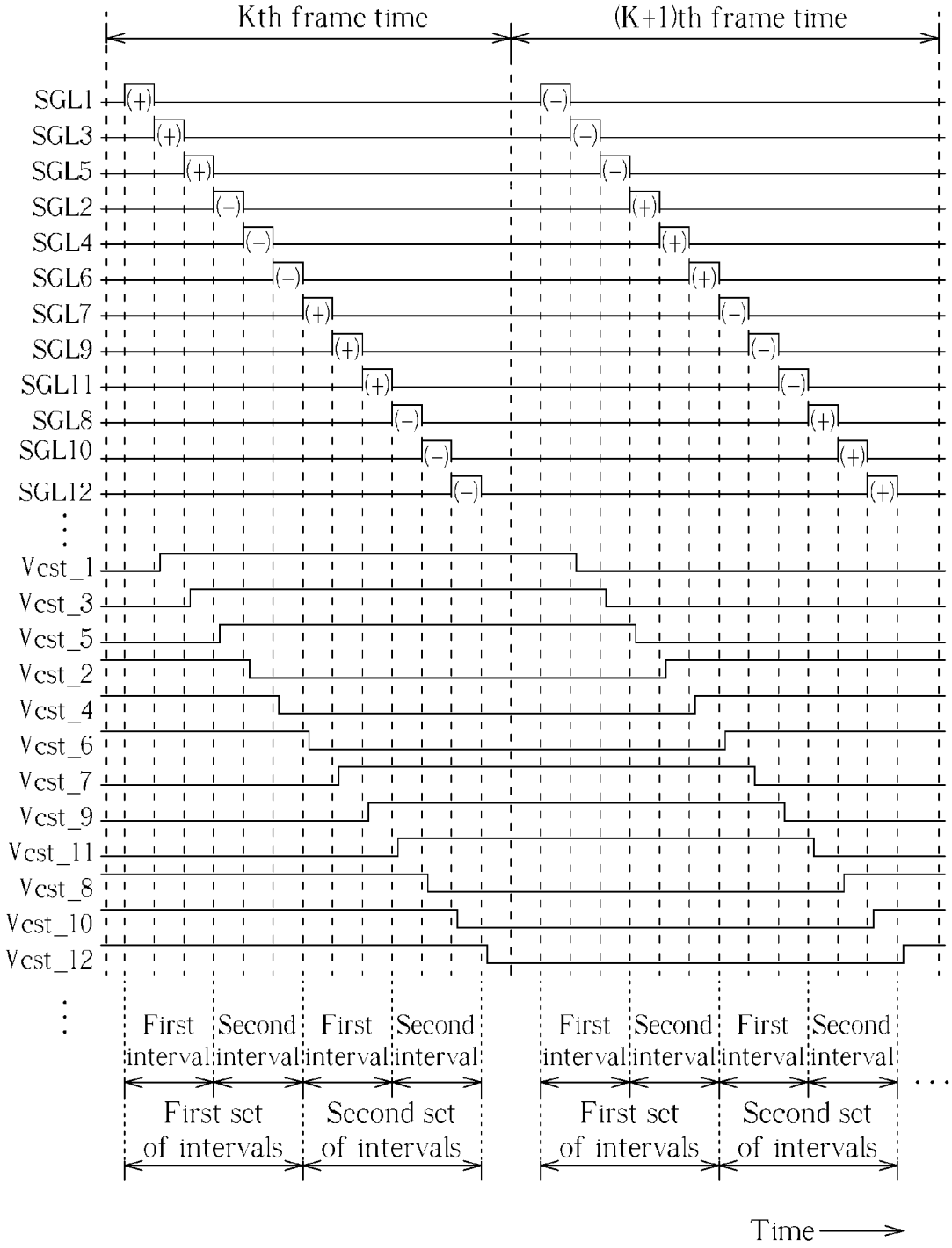
FIG. 17 shows the related signal waveforms of the gate signals and the storage capacitor common voltages for performing the row-inversion driving operation based on the LCD device in FIG. 16, having time along the abscissa.

FIG. 17 shows the related signal waveforms of the gate signals and the storage capacitor common voltages for performing the row-inversion driving operation based on the LCD device in FIG. 16, having time along the abscissa. The sign "+" in parentheses means that the polarity of the corresponding written data signal is positive, and the sign "−" in parentheses means that the polarity of the corresponding written data signal is negative. As shown in FIG. 17, during the first interval of the first set of intervals in the Kth frame time, the storage capacitor common voltages Vcst_1, Vcst_3 and Vcst_5 of the odd storage capacitor common lines LST1, LST3 and LST5 of the first set of storage capacitor common lines are firstly set to be a low voltage. Then, the gate signals SGL1, SGL3 and SGL5 of the odd gate lines GL1, GL3 and GL5 of the first set of gate lines are sequentially enabled, i.e. in ascending order, for writing the data signals with positive polarity sequentially into the pixel units 20 of the first, third and fifth rows of pixels via the data lines 16. After sequentially finishing the data writing operations corresponding to the enabled gate signals SGL1, SGL3 and SGL5, the gate signals SGL1, SGL3 and SGL5 are sequentially disabled, the storage capacitor common voltages Vcst_1, Vcst_3 and Vcst_5 are sequentially switched from the low voltage to a high voltage, and the voltage levels of the corresponding written data signals during the first interval of the first set of intervals are sequentially pulled up due to the capacitive effect of the corresponding storage capacitors 25.

During the second interval of the first set of intervals in the Kth frame time, the storage capacitor common voltages Vcst_2, Vcst_4 and Vcst_6 of the even storage capacitor common lines LST2, LST4 and LST6 of the first set of storage capacitor common lines are firstly set to be the high voltage. Then, the gate signals SGL2, SGL4 and SGL6 of the even gate lines GL2, GL4 and GL6 of the first set of gate lines are sequentially enabled, i.e. in ascending order, for writing the data signals with negative polarity sequentially into the pixel units 20 of the second, fourth and sixth rows of pixels via the data lines 16. After sequentially finishing the data writing operations corresponding to the enabled gate signals SGL2, SGL4 and SGL6, the gate signals SGL2, SGL4 and SGL6 are sequentially disabled, the storage capacitor common voltages Vcst_2, Vcst_4 and Vcst_6 are sequentially switched from the high voltage to the low voltage, and the voltage levels of the corresponding written data signals during the second interval of the first set of intervals are sequentially pulled down due to the capacitive effect of the corresponding storage capacitors 25.

During the first interval of the second set of intervals in the Kth frame time, the storage capacitor common voltages Vcst_7, Vcst_9 and Vcst_11 of the odd storage capacitor common lines LST7, LST9 and LST11 of the second set of storage capacitor common lines are firstly set to be the low voltage. Then, the gate signals SGL7, SGL9 and SGL11 of the odd gate lines GL7, GL9 and GL11 of the second set of gate lines are sequentially enabled, i.e. in ascending order, for writing the data signals with positive polarity sequentially into the pixel units 20 of the seventh, ninth and eleventh rows of pixels via the data lines 16. After sequentially finishing the data writing operations corresponding to the enabled gate signals SGL7, SGL9 and SGL11, the gate signals SGL7, SGL9 and SGL11 are sequentially disabled, the storage capacitor common voltages Vcst_7, Vcst_9 and Vcst_11 are sequentially switched from the low voltage to the high voltage, and the voltage levels of the corresponding written data signals during the first interval of the second set of intervals are sequentially pulled up due to the capacitive effect of the corresponding storage capacitors 25.

During the second interval of the second set of intervals in the Kth frame time, the storage capacitor common voltages Vcst_8, Vcst_10 and Vcst_12 of the even storage capacitor common lines LST8, LST10 and LST12 of the second set of storage capacitor common lines are firstly set to be the high voltage. Then, the gate signals SGL8, SGL10 and SGL12 of the even gate lines GL8, GL10 and GL12 of the second set of gate lines are sequentially enabled, i.e. in ascending order, for writing the data signals with negative polarity sequentially into the pixel units 20 of the eighth, tenth and twelfth rows of pixels via the data lines 16. After sequentially finishing the data writing operations corresponding to the enabled gate signals SGL8, SGL10 and SGL12, the gate signals SGL8, SGL10 and SGL12 are sequentially disabled, the storage capacitor common voltages Vcst_8, Vcst_10 and Vcst_12 are sequentially switched from the high voltage to the low voltage, and the voltage levels of the corresponding written data signals during the second interval of the second set of intervals are sequentially pulled down due to the capacitive effect of the corresponding storage capacitors 25.

During the first interval of the first set of intervals in the (K+1)th frame time, the storage capacitor common voltages Vcst_1, Vcst_3 and Vcst_5 of the odd storage capacitor common lines LST1, LST3 and LST5 of the first set of storage capacitor common lines are firstly set to be the high voltage. Then, the gate signals SGL1, SGL3 and SGL5 of the odd gate lines GL1, GL3 and GL5 of the first set of gate lines are sequentially enabled, i.e. in ascending order, for writing the data signals with negative polarity sequentially into the pixel units 20 of the first, third and fifth rows of pixels via the data lines 16. After sequentially finishing the data writing operations corresponding to the enabled gate signals SGL1, SGL3 and SGL5, the gate signals SGL1, SGL3 and SGL5 are sequentially disabled, the storage capacitor common voltages Vcst_1, Vcst_3 and Vcst_5 are sequentially switched from the high voltage to the low voltage, and the voltage levels of the corresponding written data signals during the first interval of the first set of intervals are sequentially pulled down due to the capacitive effect of the corresponding storage capacitors 25.

During the second interval of the first set of intervals in the (K+1)th frame time, the storage capacitor common voltages Vcst_2, Vcst_4 and Vcst_6 of the even storage capacitor common lines LST2, LST4 and LST6 of the first set of storage capacitor common lines are firstly set to be the low voltage. Then, the gate signals SGL2, SGL4 and SGL6 of the even gate lines GL2, GL4 and GL6 of the first set of gate lines are sequentially enabled, i.e. in ascending order, for writing the data signals with positive polarity sequentially into the pixel units 20 of the second, fourth and sixth rows of pixels via the data lines 16. After sequentially finishing the data writing operations corresponding to the enabled gate signals SGL2, SGL4 and SGL6, the gate signals SGL2, SGL4 and SGL6 are sequentially disabled, the storage capacitor common voltages Vcst_2, Vcst_4 and Vcst_6 are sequentially switched from the low voltage to the high voltage, and the voltage levels of the corresponding written data signals during the second interval of the first set of intervals are sequentially pulled up due to the capacitive effect of the corresponding storage capacitors 25.

During the first interval of the second set of intervals in the (K+1)th frame time, the storage capacitor common voltages Vcst_7, Vcst_9 and Vcst_11 of the odd storage capacitor common lines LST7, LST9 and LST11 of the second set of storage capacitor common lines are firstly set to be the high voltage. Then, the gate signals SGL7, SGL9 and SGL11 of the odd gate lines GL7, GL9 and GL11 of the second set of gate lines are sequentially enabled, i.e. in ascending order, for writing the data signals with negative polarity sequentially into the pixel units 20 of the seventh, ninth and eleventh rows of pixels via the data lines 16. After sequentially finishing the data writing operations corresponding to the enabled gate signals SGL7, SGL9 and SGL11, the gate signals SGL7, SGL9 and SGL11 are sequentially disabled, the storage capacitor common voltages Vcst_7, Vcst_9 and Vcst_11 are sequentially switched from the high voltage to the low voltage, and the voltage levels of the corresponding written data signals during the first interval of the second set of intervals are sequentially pulled down due to the capacitive effect of the corresponding storage capacitors 25.

During the second interval of the second set of intervals in the (K+1)th frame time, the storage capacitor common voltages Vcst_8, Vcst_10 and Vcst_12 of the even storage capacitor common lines LST8, LST10 and LST12 of the second set of storage capacitor common lines are firstly set to be the low voltage. Then, the gate signals SGL8, SGL10 and SGL12 of the even gate lines GL8, GL10 and GL12 of the second set of gate lines are sequentially enabled, i.e. in ascending order, for writing the data signals with positive polarity sequentially into the pixel units 20 of the eighth, tenth and twelfth rows of pixels via the data lines 16. After sequentially finishing the data writing operations corresponding to the enabled gate signals SGL8, SGL10 and SGL12, the gate signals SGL8, SGL10 and SGL12 are sequentially disabled, the storage capacitor common voltages Vcst_8, Vcst_10 and Vcst_12 are sequentially switched from the low voltage to the high voltage, and the voltage levels of the corresponding written data signals during the second interval of the second set of intervals are sequentially pulled up due to the capacitive effect of the corresponding storage capacitors 25.

Accordingly, the voltage swings of the data signals concerning the data writing operations via the data lines 16 can be reduced in that the capacitive effect of the storage capacitors 25 is able to pull up or pull down the voltage levels of the written data signals. Therefore, the power consumption corresponding to the polarity-switching operations of the data signals can be reduced, and the elements having low rated voltage can be installed in the LCD device for performing the driving operations for saving production cost.

Figure 18:
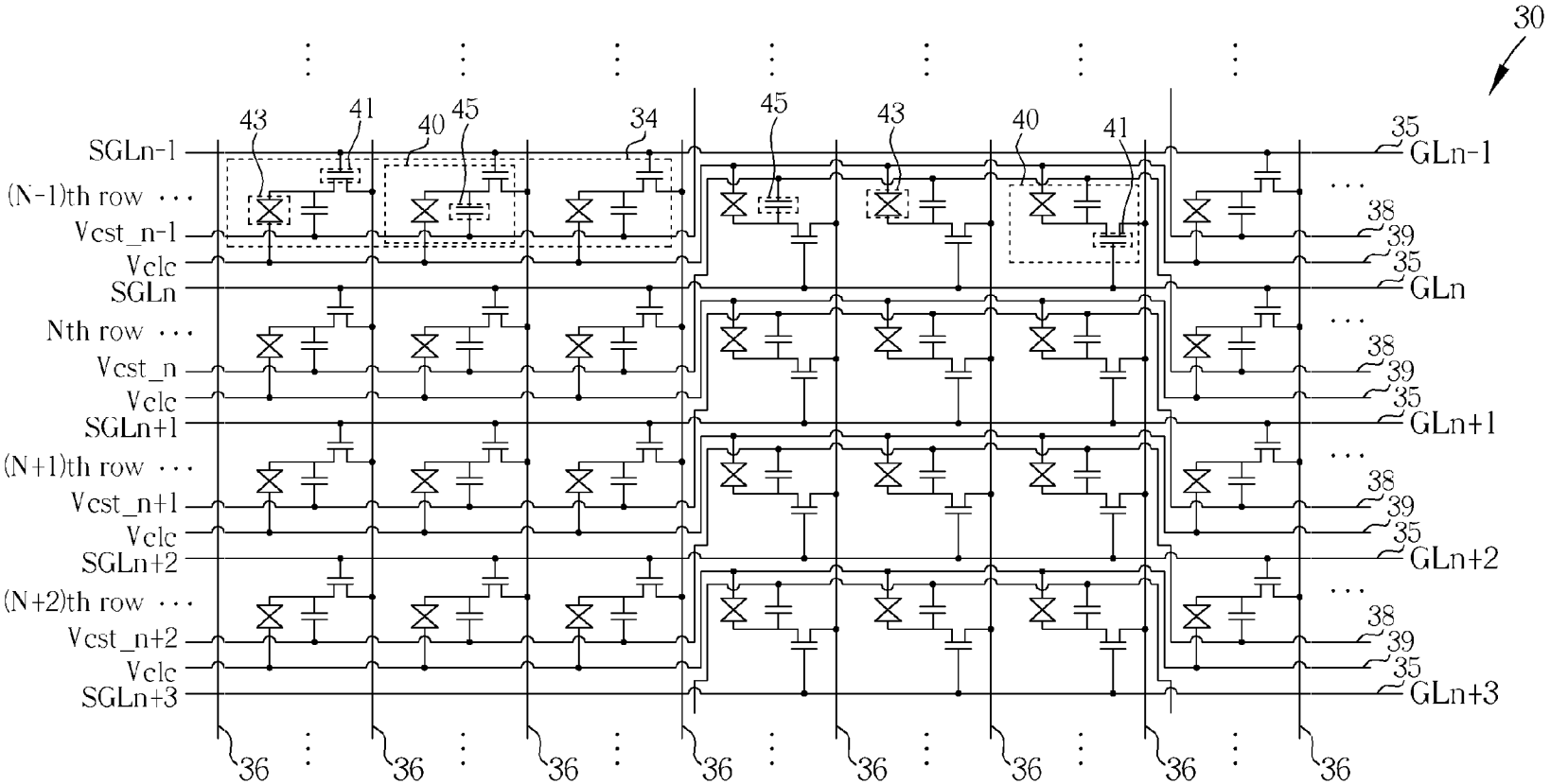
FIG. 18 is a schematic diagram showing another LCD device using the pixel-inversion driving method of the present invention.

FIG. 18 is a schematic diagram showing another LCD device using the pixel-inversion driving method of the present invention. As shown in FIG. 18, the LCD device 30 comprises a plurality of data lines 36, a plurality of gate lines 35, a plurality of storage capacitor common lines 38, a plurality of liquid-crystal capacitor common lines 39, and a plurality of rows of pixels. The plurality of gate lines 35 are divided into a plurality of sets of gate lines. Also, the plurality of storage capacitor common lines 38 are divided into a plurality of sets of storage capacitor common lines. Each row of pixels comprises a plurality of pixels 34. Each pixel 34 comprises three pixel units 40. Each pixel unit 40 is a red pixel unit, a green pixel unit, or a green pixel unit. Each pixel unit 40 comprises a data switch 41, a liquid-crystal capacitor 43, and a storage capacitor 45. Each liquid-crystal capacitor 43 is coupled to one corresponding liquid-crystal capacitor common line 39 for receiving the liquid-crystal capacitor common voltage Vclc.

The storage capacitors 45 of the same pixel 34 are coupled to the same storage capacitor common line 38 for receiving one corresponding storage capacitor common voltage. The storage capacitors 45 of adjacent pixels 34 in the same row are respectively coupled to adjacent storage capacitor common line 38. The related signal waveforms of the gate signals and the storage capacitor common voltages for performing the pixel-inversion driving operation based on the LCD device 30 are the same as the related signal waveforms shown in FIG. 17. For instance, in the pixel-inversion driving operation for generating each frame based on the LCD device 30, when the gate signal SGLn is enabled, a plurality of interlaced pixels 34 coupled to the gate line GLn in the Nth and (N−1)th rows are written with the data signals with first polarity. Afterwards, when the gate signal SGLn+1 is enabled, a plurality of interlaced pixels 34 coupled to the gate line GLn+1 in the Nth and (N+1)th rows are written with the data signals with second polarity. The first polarity is opposite to the second polarity so that the LCD device 30 is able to display pixel-inversion images based on the related signal waveforms shown in FIG. 17.

Figure 19:
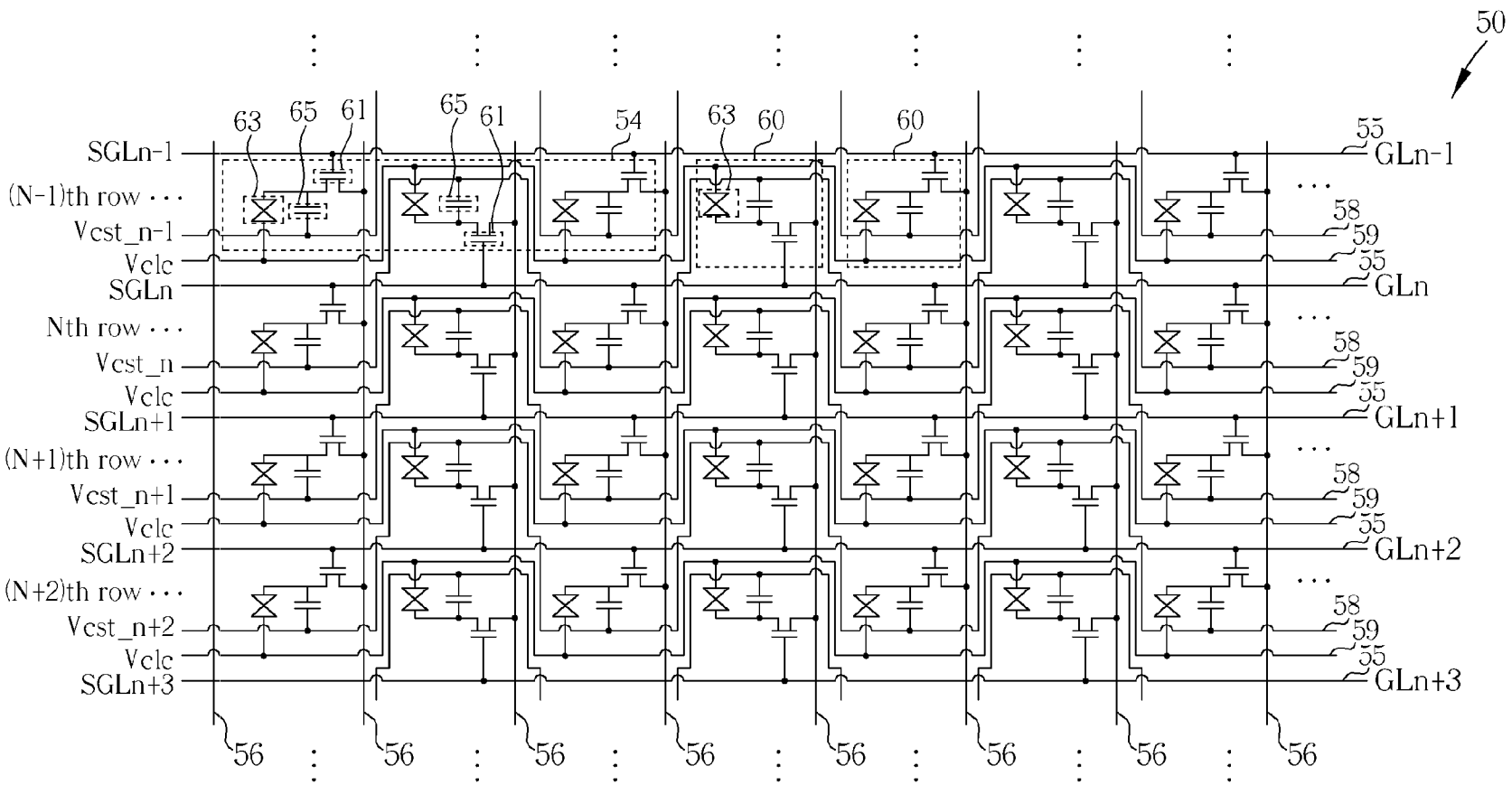
FIG. 19 is a schematic diagram showing another LCD device using the dot-inversion driving method of the present invention.

FIG. 19 is a schematic diagram showing another LCD device using the dot-inversion driving method of the present invention. As shown in FIG. 19, the LCD device 50 comprises a plurality of data lines 56, a plurality of gate lines 55, a plurality of storage capacitor common lines 58, a plurality of liquid-crystal capacitor common lines 59, and a plurality of rows of pixels. The plurality of gate lines 55 are divided into a plurality of sets of gate lines. Also, the plurality of storage capacitor common lines 58 are divided into a plurality of sets of storage capacitor common lines. Each row of pixels comprises a plurality of pixels 54. Each pixel 54 comprises three pixel units 60. Each pixel unit 60 is a red pixel unit, a green pixel unit, or a green pixel unit. Each pixel unit 60 comprises a data switch 61, a liquid-crystal capacitor 63, and a storage capacitor 65. Each liquid-crystal capacitor 63 is coupled to one corresponding liquid-crystal capacitor common line 59 for receiving the liquid-crystal capacitor common voltage Vclc.

The storage capacitors 65 of adjacent pixel units 60 in the same row are respectively coupled to adjacent storage capacitor common line 58. The related signal waveforms of the gate signals and the storage capacitor common voltages for performing the dot-inversion driving operation based on the LCD device 50 are the same as the related signal waveforms shown in FIG. 17. For instance, in the dot-inversion driving operation for generating each frame based on the LCD device 50, when the gate signal SGLn is enabled, a plurality of interlaced pixel units 60 coupled to the gate line GLn in the Nth and (N−1)th rows are written with the data signals with first polarity. Afterwards, when the gate signal SGLn+1 is enabled, a plurality of interlaced pixel units 60 coupled to the gate line GLn+1 in the Nth and (N+1)th rows are written with the data signals with second polarity. The first polarity is opposite to the second polarity so that the LCD device 30 is able to display dot-inversion images based on the related signal waveforms shown in FIG. 17.

In the aforementioned row-inversion, pixel-inversion, or dot-inversion driving method for driving the related LCD device based on the related signal waveforms shown in FIG. 17, the liquid-crystal capacitor common voltage is a DC voltage, and each storage capacitor common voltage is an AC voltage. The plurality of storage capacitor common voltages are divided into a plurality of sets of storage capacitor common voltages. The even or odd storage capacitor common lines of each set of storage capacitor common lines are furnished with storage capacitor common voltages having low voltage level for writing data signals with positive polarity. Alternatively, the even or odd storage capacitor common lines of each set of storage capacitor common lines are furnished with storage capacitor common voltages having high voltage level for writing data signals with negative polarity. Compared with the prior-art row-inversion, pixel-inversion, or dot-inversion driving method, the voltage switching frequency of each storage capacitor common voltage can be reduced for saving related power consumption. Furthermore, the voltage swings of the data signals concerning the data writing operations can be reduced in that the capacitive effect of the storage capacitors is able to pull up or pull down the voltage levels of the written data signals. Therefore, the power consumption corresponding to polarity-switching operations of the data signals can be reduced, and the elements having low rated voltage can be installed in the LCD device for performing the driving operations for saving production cost.

Figure 20:
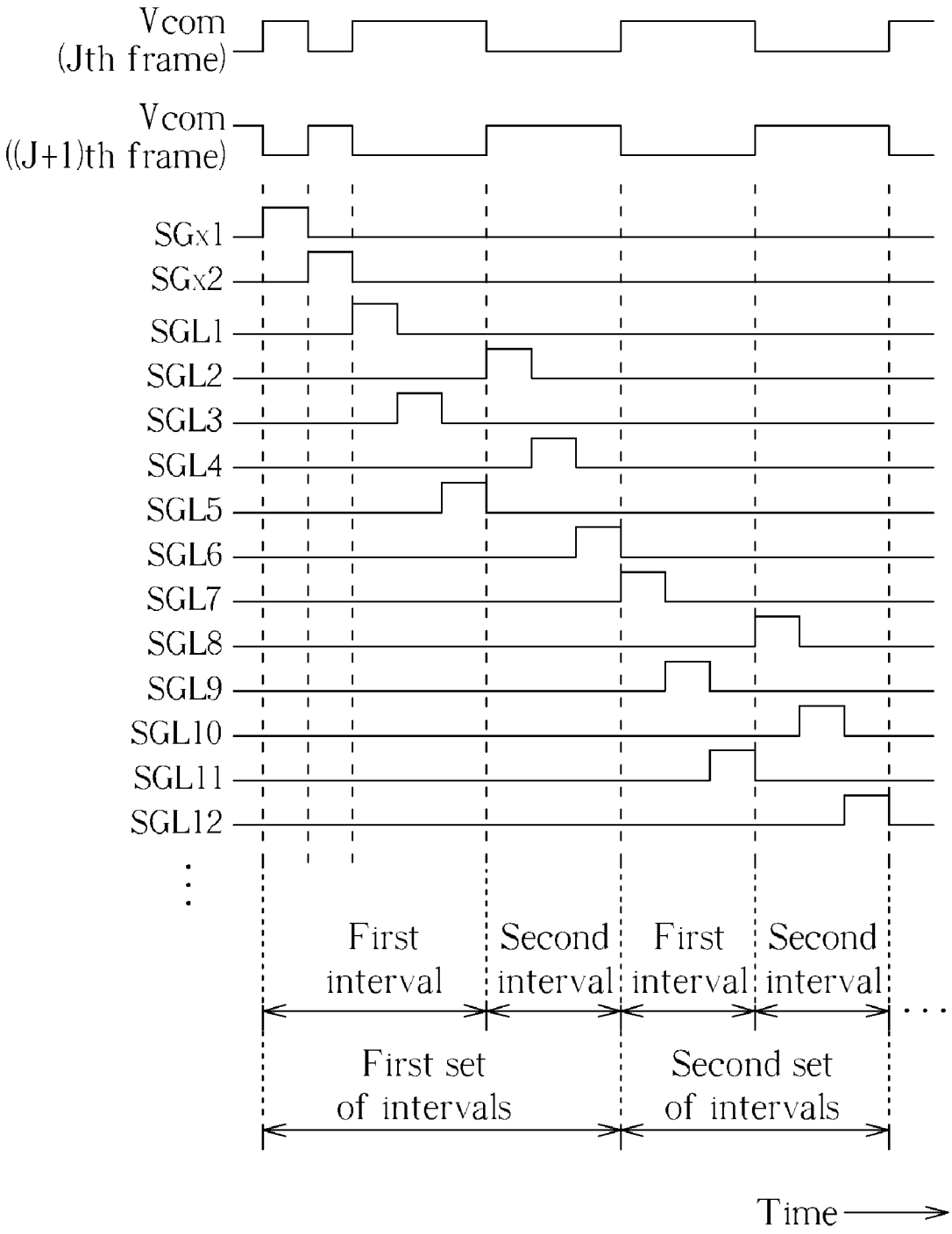
FIG. 20 shows the related signal waveforms regarding the operation of the LCD device in FIG. 4 for generating the jth frame and the (J+1)th frame based on the row-inversion driving method, having time along the abscissa.

FIG. 20 shows the related signal waveforms regarding the operation of the LCD device in FIG. 4 for generating the jth frame and the (J+1)th frame based on the row-inversion driving method, having time along the abscissa. In the following description, if the polarities of data signals written into the pixel units of odd rows and even rows in the jth frame are positive and negative respectively, then the polarities of data signals written into the pixel units of odd rows and even rows in the (J+x)th frame are negative and positive respectively, and the polarities of data signals written into the pixel units of odd rows and even rows in the (J+y)th frame are positive and negative respectively. The numbers x and y are an odd number and an even number respectively. The signal waveforms in FIG. 20, from top to bottom, are the common voltage Vcom corresponding to the jth frame, the common voltage Vcom corresponding to the (J+1)th frame, a first auxiliary gate signal SGx1, a second auxiliary gate signal SGx2, and a plurality of gate signals SGL1-SGL12.

As shown in FIG. 20, during the first interval of the first set of intervals, the common voltage Vcom is firstly set to be a first common voltage, and the first auxiliary gate signal SGx1 is enabled for writing auxiliary data signals with first polarity. Then, the common voltage Vcom is set to be a second common voltage and the second auxiliary gate signal SGx2 is enabled for writing auxiliary data signals with second polarity. Thereafter, the common voltage Vcom is set to be the first common voltage, and the gate signals SGL1, SGL3 and SGL5 of the odd gate lines GL1, GL3 and GL5 in the first set of gate lines are sequentially enabled, i.e. in ascending order, for writing data signals with first polarity sequentially into the pixel units 470 of the first, third and fifth rows of pixels. The first polarity is opposite to the second polarity. If the first polarity is positive, then the second common voltage is greater than the first common voltage. If the first polarity is negative, then the first common voltage is greater than the second common voltage. If the first polarity corresponding to the jth frame is positive, then the first polarity corresponding to the (J+1)th frame is negative, and vice versa.

During the second interval of the first set of intervals, the common voltage Vcom is set to be the second common voltage, and the gate signals SGL2, SGL4 and SGL6 of the even gate lines GL2, GL4 and GL6 in the first set of gate lines are sequentially enabled, i.e. in ascending order, for writing data signals with second polarity sequentially into the pixel units 470 of the second, fourth and sixth rows of pixels. During the first interval of the second set of intervals, the common voltage Vcom is set to be the first common voltage, and the gate signals SGL7, SGL9 and SGL11 of the odd gate lines GL7, GL9 and GL11 in the second set of gate lines are sequentially enabled, i.e. in ascending order, for writing data signals with first polarity sequentially into the pixel units 470 of the seventh, ninth and eleventh rows of pixels. During the second interval of the second set of intervals, the common voltage Vcom is set to be the second common voltage, and the gate signals SGL8, SGL10 and SGL12 of the even gate lines GL8, GL10 and GL12 in the second set of gate lines are sequentially enabled, i.e. in ascending order, for writing data signals with second polarity sequentially into the pixel units 470 of the eighth, tenth and twelfth rows of pixels.

Figure 21:
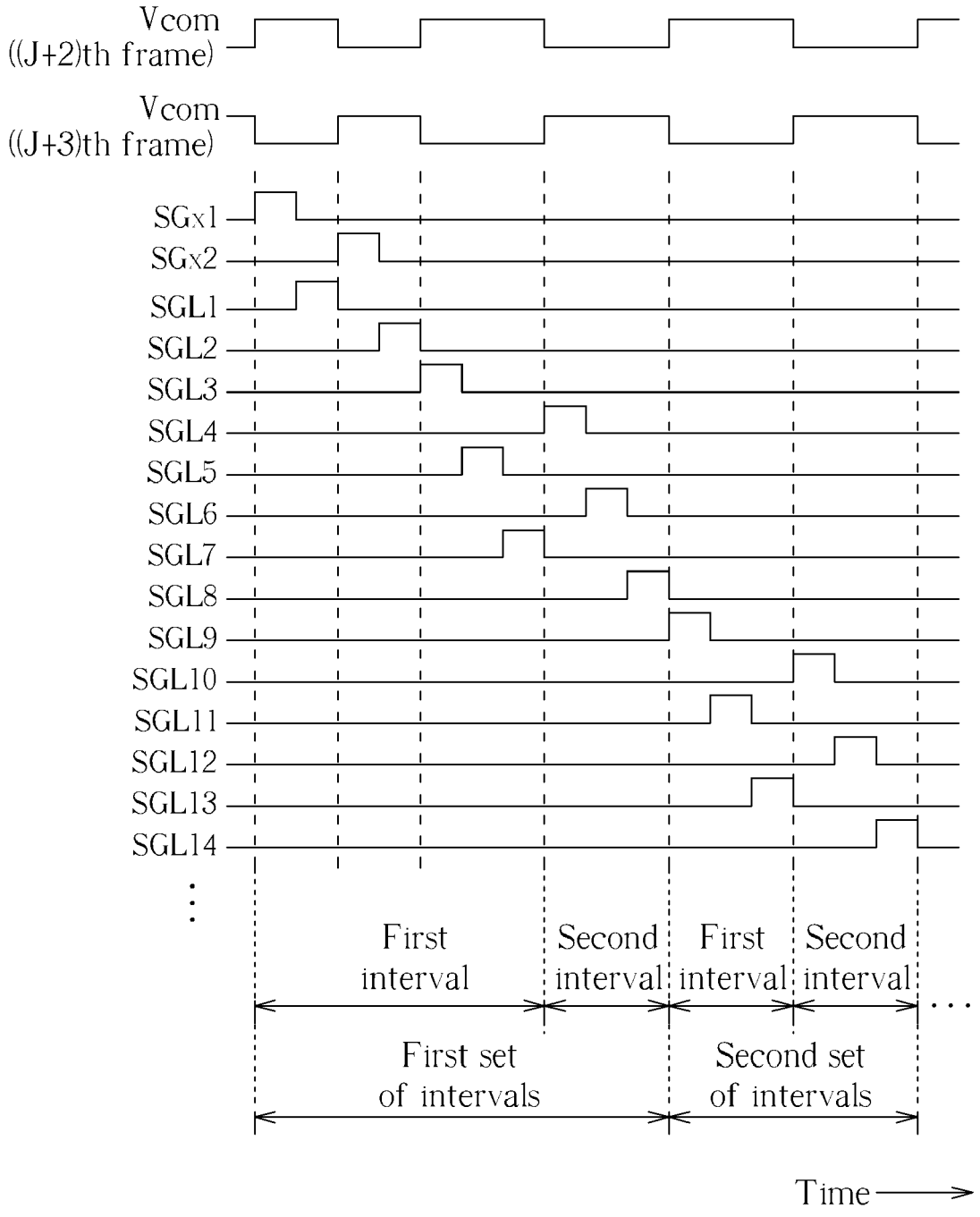
FIG. 21 shows the related signal waveforms regarding the operation of the LCD device in FIG. 4 for generating the (J+2)th frame and the (J+3)th frame based on the row-inversion driving method, having time along the abscissa.

FIG. 21 shows the related signal waveforms regarding the operation of the LCD device in FIG. 4 for generating the (J+2)th frame and the (J+3)th frame based on the row-inversion driving method, having time along the abscissa. The signal waveforms in FIG. 21, from top to bottom, are the common voltage Vcom corresponding to the (J+2)th frame, the common voltage Vcom corresponding to the (J+3)th frame, the first auxiliary gate signal SGx1, the second auxiliary gate signal SGx2, and the plurality of gate signals SGL1-SGL14. As shown in FIG. 21, during the first interval of the first set of intervals, the common voltage Vcom is firstly set to be the first common voltage, and the first auxiliary gate signal SGx1 and the gate signal SGL1 are sequentially enabled respectively for writing auxiliary data signals with first polarity and writing data signals with first polarity into the pixel units 470 of the first row of pixels. Then, the common voltage Vcom is set to be the second common voltage, and the second auxiliary gate signal SGx2 and the gate signal SGL2 are sequentially enabled respectively for writing auxiliary data signals with second polarity and writing data signals with second polarity into the pixel units 470 of the second row of pixels. Thereafter, the common voltage Vcom is set to be the first common voltage, and the gate signals SGL3, SGL5 and SGL7 of the odd gate lines GL3, GL5 and GL7 in the first and second sets of gate lines are sequentially enabled, i.e. in ascending order, for writing data signals with first polarity sequentially into the pixel units 470 of the third, fifth and seventh rows of pixels.

During the second interval of the first set of intervals, the common voltage Vcom is set to be the second common voltage, and the gate signals SGL4, SGL6 and SGL8 of the even gate lines GL4, GL6 and GL8 in the first and second sets of gate lines are sequentially enabled, i.e. in ascending order, for writing data signals with second polarity sequentially into the pixel units 470 of the fourth, sixth and eighth rows of pixels. During the first interval of the second set of intervals, the common voltage Vcom is set to be the first common voltage, and the gate signals SGL9, SGL11 and SGL13 of the odd gate lines GL9, GL11 and GL13 in the second and third sets of gate lines are sequentially enabled, i.e. in ascending order, for writing data signals with first polarity sequentially into the pixel units 470 of the ninth, eleventh and thirteenth rows of pixels. During the second interval of the second set of intervals, the common voltage Vcom is set to be the second common voltage, and the gate signals SGL10, SGL12 and SGL14 of the even gate lines GL10, GL12 and GL14 in the second and third sets of gate lines are sequentially enabled, i.e. in ascending order, for writing data signals with second polarity sequentially into the pixel units 470 of the tenth, twelfth and fourteenth rows of pixels.

Figure 22:
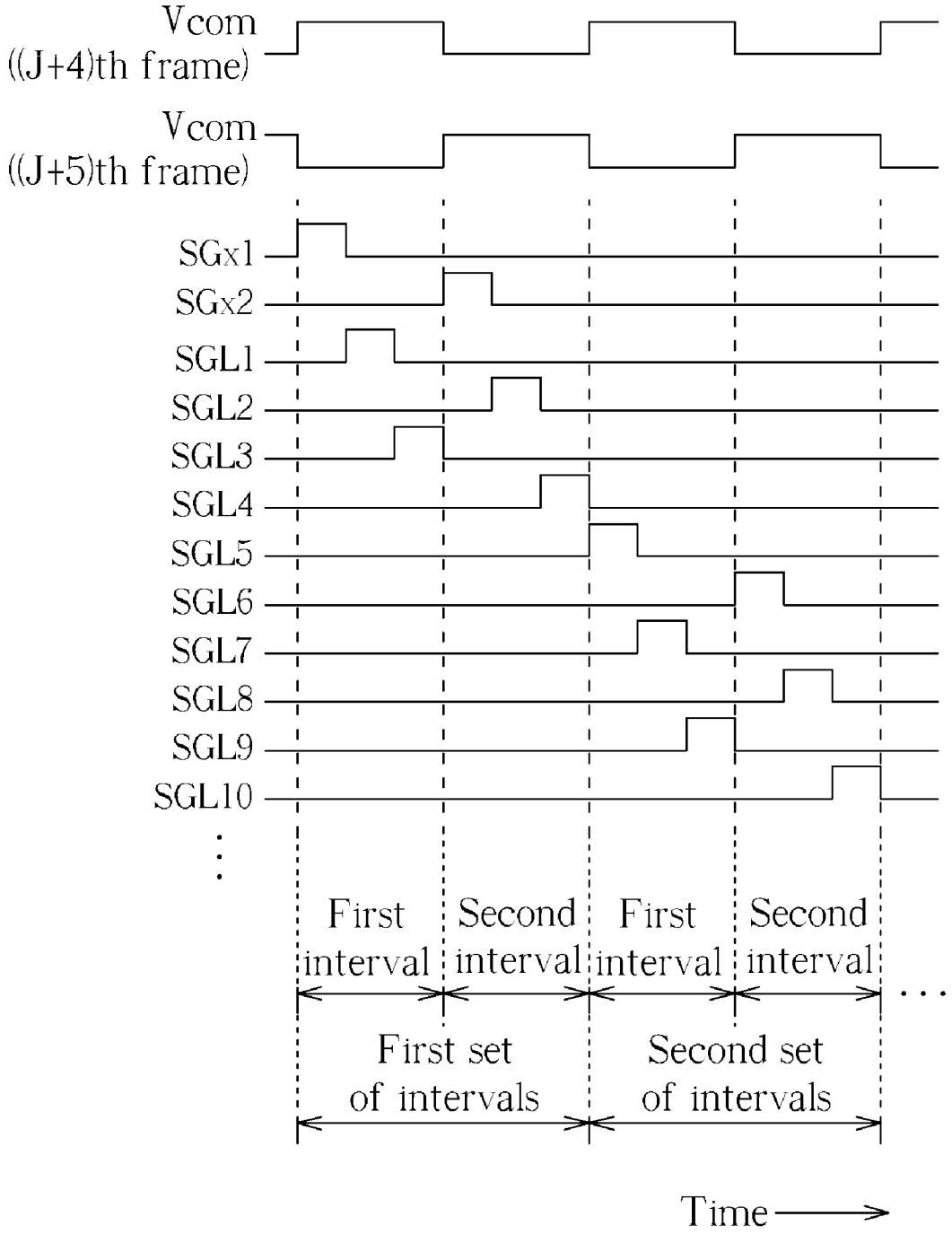
FIG. 22 shows the related signal waveforms regarding the operation of the LCD device in FIG. 4 for generating the (J+4)th frame and the (J+5)th frame based on the row-inversion driving method, having time along the abscissa.

FIG. 22 shows the related signal waveforms regarding the operation of the LCD device in FIG. 4 for generating the (J+4)th frame and the (J+5)th frame based on the row-inversion driving method, having time along the abscissa. The signal waveforms in FIG. 22, from top to bottom, are the common voltage Vcom corresponding to the (J+4)th frame, the common voltage Vcom corresponding to the (J+5)th frame, the first auxiliary gate signal SGx1, the second auxiliary gate signal SGx2, and the plurality of gate signals SGL1-SGL10. As shown in FIG. 22, during the first interval of the first set of intervals, the common voltage Vcom is set to be the first common voltage, and the first auxiliary gate signal SGx1 and the gate signals SGL1, SGL3 are sequentially enabled respectively for writing auxiliary data signals with first polarity and writing data signals with first polarity into the pixel units 470 of the first and third rows of pixels. During the second interval of the first set of intervals, the common voltage Vcom is set to be the second common voltage, and the second auxiliary gate signal SGx2 and the gate signals SGL2, SGL4 are sequentially enabled respectively for writing auxiliary data signals with second polarity and writing data signals with second polarity into the pixel units 470 of the second and fourth rows of pixels.

During the first interval of the second set of intervals, the common voltage Vcom is set to be the first common voltage, and the gate signals SGL5, SGL7 and SGL9 of the odd gate lines GL5, GL7 and GL9 in the first and second sets of gate lines are sequentially enabled, i.e. in ascending order, for writing data signals with first polarity sequentially into the pixel units 470 of the fifth, seventh and ninth rows of pixels. During the second interval of the second set of intervals, the common voltage Vcom is set to be the second common voltage, and the gate signals SGL6, SGL8 and SGL10 of the even gate lines GL6, GL8 and GL10 in the first and second sets of gate lines are sequentially enabled, i.e. in ascending order, for writing data signals with second polarity sequentially into the pixel units 470 of the sixth, eighth and tenth rows of pixels.

In the aforementioned row-inversion driving method for driving the LCD device in FIG. 4 based on the related signal waveforms shown in FIGS. 20 through 22, the first auxiliary gate signal SGx1 and the second auxiliary gate signal SGx2 are interleaved into the gate signals of the first set of gate lines during the first or second intervals of the first set of intervals in different enable-sequence arrangements between consecutive frames. Accordingly, the write operations for the following intervals, i.e. after the first set of intervals, are performed based on different enable-sequence arrangements of related gate signals for consecutive frames. From the above-mentioned, the related gate signals being sequentially enabled during each interval are not limited to correspond to a certain set of gate lines. In other words, the related gate signals being sequentially enabled during each interval may comprise the gate signals corresponding to different sets of gate lines.

It is then noted that the start and end gate lines of the related gate lines being enabled during each interval are different between consecutive frames in the row-inversion driving method based on the related waveforms in FIGS. 20 through 22. For that reason, the band mura effect resulting from the edge gate lines of each set of gate lines can be suppressed for improving display quality. In one embodiment, the LCD device 400 in FIG. 4 may further comprise a first auxiliary gate line, a second auxiliary gate line, a first auxiliary row of pixels, and a second auxiliary row of pixels for performing data writing operations regarding the auxiliary gate signals. In another embodiment, the first auxiliary gate signal SGx1, the second auxiliary gate signal SGx2 and the auxiliary data signals are virtual signals, and the data writing operations regarding the auxiliary data signals are virtual data writing operations so that the LCD device 400 cab be operated without the aid of the first auxiliary gate line, the second auxiliary gate line, the first auxiliary row of pixels, and the second auxiliary row of pixels.

To sum up, in one embodiment, the LCD driving method of the present invention is provided for driving LCD devices based on the interlace-commutate scanning process for sequentially enabling a plurality of sets of gate lines. In another embodiment, the LCD driving method of the present invention is provided for driving LCD devices based on different start and end gate lines of the related gate lines being enabled during each interval. Accordingly, in the LCD driving method of the present invention, the mura effect caused by the deviation of the data signals between adjacent rows of pixel units can be suppressed, and the unwanted frame brightness gradient can also be reduced. Besides, the data signals with positive polarity are written based on the low common voltage, and the data signals with negative polarity are written based on the high common voltage so that the voltage swings of the data signals regarding data writing operations can be reduced for lowering the power consumption, and the elements having low rated voltage can be installed in the LCD device for performing the driving operations for saving production cost.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A method for driving an LCD device, the LCD device comprising a plurality of rows of pixels, a plurality of sets of gate lines, and a plurality of data lines, the method comprising:

sequentially enabling a plurality of gate signals corresponding to a plurality of odd gate lines in a first set of gate lines based on an ascending order during a first interval of a first set of intervals corresponding to an Nth frame;

sequentially writing a plurality of data signals with a first polarity into a plurality of corresponding rows of pixels via the data lines based on the sequentially enabled gate signals corresponding to the odd gate lines in the first set of gate lines during the first interval of the first set of intervals corresponding to the Nth frame;

setting a first common voltage to a storage capacitor common voltage during the first interval of the first set of intervals corresponding to the Nth frame;

sequentially enabling a plurality of gate signals corresponding to a plurality of even gate lines in the first set of gate lines based on an ascending order during a second interval following the first interval of the first set of intervals corresponding to the Nth frame;

sequentially writing a plurality of data signals with a second polarity into a plurality of corresponding rows of pixels via the data lines based on the sequentially enabled gate signals corresponding to the odd gate lines in the first set of gate lines during the second interval of the first set of intervals corresponding to the Nth frame;

setting a second common voltage to a storage capacitor common voltage during the second interval of the first set of intervals corresponding to the Nth frame;

sequentially enabling a plurality of gate signals corresponding to a plurality of even gate lines in a second set of gate lines based on a descending order during a first interval of a second set of intervals following the first set of intervals corresponding to the Nth frame;

sequentially writing a plurality of data signals with a second polarity into a plurality of corresponding rows of pixels via the data lines based on the sequentially enabled gate signals corresponding to the even gate lines in the second set of gate lines during the first interval of the second set of intervals corresponding to the Nth frame;

setting a second common voltage to a storage capacitor common voltage during the first interval of the second set of intervals corresponding to the Nth frame;

sequentially enabling a plurality of gate signals corresponding to a plurality of odd gate lines in the second set of gate lines based on a descending order during a second interval following the first interval of the second set of intervals corresponding to the Nth frame;

sequentially writing a plurality of data signals with the first polarity into a plurality of corresponding rows of pixels via the data lines based on the sequentially enabled gate signals corresponding to the odd gate lines in the second set of gate lines during the second interval of the second set of intervals corresponding to the Nth frame; and setting a first common voltage to a storage capacitor common voltage during the second interval of the second set of intervals corresponding to the Nth frame;

wherein the first common voltage is different from the second common voltage, and the first polarity is opposite to the second polarity.

2. The method of claim 1, wherein the first polarity is a positive polarity, the second polarity is a negative polarity, and the second common voltage is greater than the first common voltage.

3. The method of claim 1, wherein the first polarity is a negative polarity, the second polarity is a positive polarity, and the second common voltage is less than the first common voltage.

4. The method of claim 1, further comprising:

sequentially enabling a plurality of gate signals corresponding to a plurality of odd gate lines in a third set of gate lines adjacent to the second set of gate lines based on an ascending order, and sequentially writing a plurality of data signals with the first polarity into a plurality of corresponding rows of pixels via the data lines based on the sequentially enabled gate signals corresponding to the odd gate lines in the third set of gate lines during a first interval of a third set of intervals following the second set of intervals corresponding to the Nth frame; and sequentially enabling a plurality of gate signals corresponding to a plurality of even gate lines in the third set of gate lines based on an ascending order, and sequentially writing a plurality of data signals with the second polarity into a plurality of corresponding rows of pixels via the data lines based on the sequentially enabled gate signals corresponding to the even gate lines in the third set of gate lines during a second interval of the third set of intervals corresponding to the Nth frame;

wherein the first interval is prior to the second interval in the third set of intervals corresponding to the Nth frame.

5. The method of claim 1, further comprising:

setting the first common voltage to the liquid-crystal capacitor common voltage and the storage capacitor common voltage, sequentially enabling a plurality of gate signals corresponding to a plurality of odd gate lines in a third set of gate lines adjacent to the second set of gate lines based on an ascending order, and sequentially writing a plurality of data signals with the first polarity into a plurality of corresponding rows of pixels via the data lines based on the sequentially enabled gate signals corresponding to the odd gate lines in the third set of gate lines during a first interval of a third set of intervals following the second set of intervals corresponding to the Nth frame; and setting the second common voltage to the liquid-crystal capacitor common voltage and the storage capacitor common voltage, sequentially enabling a plurality of gate signals corresponding to a plurality of even gate lines in the third set of gate lines based on an ascending order, and sequentially writing a plurality of data signals with the second polarity into a plurality of corresponding rows of pixels via the data lines based on the sequentially enabled gate signals corresponding to the even gate lines in the third set of gate lines during a second interval of the third set of intervals corresponding to the Nth frame;

wherein the first interval is prior to the second interval in the third set of intervals corresponding to the Nth frame.

6. The method of claim 1, further comprising:

sequentially enabling a plurality of gate signals corresponding to a plurality of odd gate lines in a third set of gate lines based on the first sequential order during the first interval of the first set of intervals corresponding to a (N+1)th frame; and sequentially enabling a plurality of gate signals corresponding to a plurality of even gate lines in a fourth set of gate lines based on the second sequential order during the second interval of the first set of intervals corresponding to the (N+1)th frame;

wherein the third set of gate lines is partly different from the first set of gate lines, and the fourth set of gate lines is partly different from the second set of gate lines.

7. A method for driving an LCD device, the LCD device comprising a plurality of rows of pixels, a plurality of sets of gate lines, and a plurality of data lines, the method comprising:

sequentially enabling a plurality of gate signals corresponding to a plurality of odd gate lines in a first set of gate lines based on the first sequential order during a first interval of the first set of intervals;

setting a liquid-crystal capacitor voltage to a liquid-crystal capacitor common voltage and setting a first storage capacitor voltage firstly to a first set of odd storage capacitor common voltages during the first interval of the first set of intervals;

sequentially writing a plurality of data signals with a first polarity into a plurality of corresponding rows of pixels via the data lines based on the sequentially enabled gate signals corresponding to the odd gate lines in the first set of gate lines during the first interval of the first set of intervals, the gate signals corresponding to the odd gate lines in the first set of gate lines being sequentially disabled after writing the corresponding data signals;

sequentially setting a second storage capacitor voltage to the first set of odd storage capacitor common voltages based on the first sequential order, each odd storage capacitor common voltage of the first set of odd storage capacitor common voltages being set to be the second storage capacitor voltage after a gate signal corresponding to a respective odd gate line in the first set of gate lines is disabled;

sequentially enabling a plurality of gate signals corresponding to a plurality of even gate lines in a first set of gate lines based on a second sequential order during the second interval of the first set of intervals;

setting the liquid-crystal capacitor voltage to the liquid-crystal capacitor common voltage and setting the second storage capacitor voltage firstly to a first set of even storage capacitor common voltages during the second interval of the first set of intervals;

sequentially writing a plurality of data signals with a second polarity into a plurality of corresponding rows of pixels via the data lines based on the sequentially enabled gate signals corresponding to the even gate lines in the first set of gate lines during the second interval of the first set of intervals, the gate signals corresponding to the even gate lines in the first set of gate lines being sequentially disabled after writing the corresponding data signals; and sequentially setting a first storage capacitor voltage to the first set of even storage capacitor common voltages based on the second sequential order, each even storage capacitor common voltage of the first set of even storage capacitor common voltages being set to be the first storage capacitor voltage after a gate signal corresponding to a respective even gate line in the first set of gate lines is disabled.

8. The method of claim 7, wherein the first polarity is a positive polarity, the second polarity is a negative polarity, and the second storage capacitor voltage is greater than the first storage capacitor voltage.

9. The method of claim 7, wherein the first polarity is a negative polarity, the second polarity is a positive polarity, and the second storage capacitor voltage is less than the first storage capacitor voltage.

* * * * *